US008511390B2

(12) United States Patent
Coyle et al.

(10) Patent No.: US 8,511,390 B2
(45) Date of Patent: Aug. 20, 2013

(54) RIGLESS LOW VOLUME PUMP SYSTEM

(75) Inventors: Robert A. Coyle, Katy, TX (US); William Michel, Azerailles (FR); Louis-Claude Porel, Azerailles (FR); Alistair Gill, Houston, TX (US); Paul Ellerton, Derby (GB); David Fielding, Derby (GB)

(73) Assignee: BP Corporation North America Inc., Houston, TX (US)

( * ) Notice: Subject to any disclaimer, the term of this patent is extended or adjusted under 35 U.S.C. 154(b) by 359 days.

(21) Appl. No.: 12/976,636

(22) Filed: Dec. 22, 2010

(65) Prior Publication Data

US 2011/0186302 A1 Aug. 4, 2011

Related U.S. Application Data

(60) Provisional application No. 61/289,440, filed on Dec. 23, 2009.

(51) Int. Cl.
*E21B 43/00* (2006.01)
*F04B 17/03* (2006.01)

(52) U.S. Cl.
USPC ..... 166/369; 166/66.4

(58) Field of Classification Search
USPC ..... 417/65, 92, 269; 92/70, 71
See application file for complete search history.

(56) References Cited

U.S. PATENT DOCUMENTS

| | | | |
|---|---|---|---|
| 2,431,492 | A | 11/1947 | Lewis |
| 2,972,955 | A | 2/1961 | Richter et al. |
| 3,075,778 | A | 1/1963 | Bowers et al. |
| 3,398,694 | A | 8/1968 | Lerch |
| 3,589,838 | A | 6/1971 | Tuzson |
| 4,406,598 | A | 9/1983 | Walling |
| 4,486,152 | A | 12/1984 | Porel |
| 4,597,722 | A | 7/1986 | Tichy |
| 4,738,595 | A | 4/1988 | Gaiser |
| 4,771,832 | A | 9/1988 | Bridges |

(Continued)

FOREIGN PATENT DOCUMENTS

EP 1916380 A1 4/2008

OTHER PUBLICATIONS

Manring, Noah D., Hydraulic Control Systems, 2005, John Wiley & Sons, ed. 1, 279-301.*

(Continued)

*Primary Examiner* — Jennifer H Gay
*Assistant Examiner* — Caroline Butcher
(74) *Attorney, Agent, or Firm* — John L. Wood

(57) ABSTRACT

A deliquification pump for deliquifying a well comprises a fluid end pump adapted to pump a fluid from a wellbore. In addition, the deliquification pump comprises a hydraulic pump adapted to drive the fluid end pump. The hydraulic pump includes a first internal pump chamber and a first pump assembly disposed in the first chamber. The first pump assembly includes a piston having a first end, a second end, and a throughbore extending between the first end and the second end. In addition, the first pump assembly includes a first wobble plate including a planar end face axially adjacent the second end of the piston and a slot extending axially through the first wobble plate. The first wobble plate is adapted to rotate about the central axis relative to the housing to axially reciprocate the piston and cyclically place the throughbore of the piston in fluid communication with the slot.

23 Claims, 20 Drawing Sheets

(56) References Cited

U.S. PATENT DOCUMENTS

| | | | | |
|---|---|---|---|---|
| 4,787,828 | A | 11/1988 | Schweitzer et al. | |
| 4,880,363 | A * | 11/1989 | Holland | 417/390 |
| 5,067,753 | A | 11/1991 | Porel | |
| 6,273,188 | B1 | 8/2001 | McCafferty et al. | |
| 6,811,709 | B2 * | 11/2004 | Arnaud | 210/750 |
| 7,059,881 | B2 * | 6/2006 | Song et al. | 439/191 |
| 7,249,634 | B2 | 7/2007 | de Alburque Lima Goncalves et al. | |
| 7,374,005 | B2 | 5/2008 | Gray, Jr. | |
| 7,730,937 | B2 | 6/2010 | Head | |
| 8,177,526 | B2 | 5/2012 | Dowling et al. | |
| 2004/0042906 | A1 * | 3/2004 | Gleasman et al. | 417/222.1 |
| 2004/0144534 | A1 * | 7/2004 | Lee | 166/265 |
| 2005/0095144 | A1 * | 5/2005 | Shimizu | 417/244 |
| 2006/0045781 | A1 | 3/2006 | Liknes | |
| 2006/0289170 | A1 | 12/2006 | Wood | |
| 2007/0022751 | A1 * | 2/2007 | Galba | 60/489 |
| 2008/0080991 | A1 * | 4/2008 | Yuratich et al. | 417/390 |
| 2009/0211753 | A1 | 8/2009 | Emtiazian et al. | |
| 2009/0218091 | A1 | 9/2009 | Dotson | |
| 2010/0143166 | A1 | 6/2010 | Head | |
| 2012/0034113 | A1 | 2/2012 | Porel | |

OTHER PUBLICATIONS

PCT International Search Report and the Written Opinion of the International Searching Authority, issued in International application No. PCT/US2010/061871, mailed Jul. 29, 2011, 8 pages.

Office Action issued in U.S. Appl. No. 12/881,512, mailed on Oct. 12, 2012, 14 pages.

* cited by examiner

RIGLESS LOW VOLUME PUMP SYSTEM

CROSS-REFERENCE TO RELATED APPLICATIONS

This application claims benefit of U.S. provisional patent application Ser. No. 61/289,440 filed Dec. 23, 2009, and entitled "Rigless Low Volume Pump System," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to the field of hydrocarbon production. More particularly, the invention relates to systems, methods, and apparatus for deliquifying a well to enhance production.

2. Background of the Technology

Geological structures that yield gas typically produce water and other liquids that accumulate at the bottom of the wellbore. The liquids typically comprise hydrocarbon condensate (e.g., relatively light gravity oil) and interstitial water in the reservoir. The liquids accumulate in the wellbore in two forms, both as single phase liquid entering from the reservoir and as condensing liquids, falling back in the wellbore. The condensing liquids actually enter the wellbore as a vapor and as they travel up the wellbore, they drop below dew point and condense. In either case, the higher density liquid-phase, being essentially discontinuous, must be transported to the surface by the gas.

In some hydrocarbon producing wells that produce both gas and liquid, the formation gas pressure and volumetric flow rate are sufficient to lift the produced liquids to the surface. In such wells, accumulation of liquids in the wellbore generally does not hinder gas production. However, in the event the gas phase does not provide sufficient transport energy to lift the liquids out of the well (i.e. the formation gas pressure and volumetric flow rate are not sufficient to lift the produced liquids to the surface), the liquid will accumulate in the well bore.

In many cases, the hydrocarbon well may initially produce gas with sufficient pressure and volumetric flow to lift produced liquids to the surface, however, over time, the produced gas pressure and volumetric flow rate decrease until they are no longer capable of lifting the produced liquids to the surface. Specifically, as the life of a natural gas well matures, reservoir pressures that drive gas production to surface decline, resulting in lower production. At some point, the gas velocities drop below the "Critical Velocity" (CV), which is the minimum velocity required to carry a droplet of water to the surface. As time progresses these droplets accumulate in the bottom of the wellbore. The accumulation of liquids in the well impose an additional back-pressure on the formation and may begin to cover the gas producing portion of the formation, thereby restricting the flow of gas, thereby restricting the flow of gas and detrimentally affecting the production capacity of the well. Once the liquid will no longer flow with the produced gas to the surface, the well will eventually become "loaded" as the liquid hydrostatic head begins to overcome the lifting action of the gas flow, at which point the well is "killed" or "shuts itself in." Thus, the accumulation of liquids such as water in a natural gas well tends to reduce the quantity of natural gas which can be produced from a given well. Consequently, it may become necessary to use artificial lift techniques to remove the accumulated liquid from the wellbore to restore the flow of gas from the formation. The process for removing such accumulated liquids from a wellbore is commonly referred to as deliquification.

For oil wells that primarily produce single phase liquids (oil and water) with a minimal amount of entrained gas, there are numerous artificial lift techniques. The most commonly employed type of artificial lift requires pulling 30 foot tubing joints from the well, attaching a fluid pump to the lowermost joint, and running the pump downhole on the string of tubing joints. The fluid pump may be driven by jointed rods attached to a beam pump, a downhole electric motor supplied with electrical power from the surface via wires banded to the outside of the tubing string, or a surface hydraulic pump displacing a power fluid to the downhole fluid pump via multiple hydraulic lines. Although there are several types of artificial lift used in lifting oil, they usually require an expensive method of deployment consisting of workover rigs, coiled tubing units, cable spoolers, and multiple personnel on-site.

Initially, artificial lift techniques employed with oil producing wells were used to deliquify gas producing wells (i.e., remove liquids from gas producing wells). However, the adaptation of existing oilfield artificial lift technologies for gas producing wells generated a whole new set of challenges. The first challenge was commercial. When employing artificial lift techniques in an oil well, revenue is immediately generated—valuable oil is lifted to the surface. In contrast, when deliquifying a gas well, additional expense is generated mostly from non-revenue generating liquids—typically, water and small amounts of condensed light hydrocarbons are lifted to the surface. The benefit, however, is the ability to maintain and potentially increasing the production of gas for extended time, thereby creating additional recoverable reserves. Typically, at 100 psi downhole pressure, the critical velocity, and hence need for artificial lift, occurs at less than 300 mcfd. The typical gas well in the United States averages about 110 mcfd, and about 90% of all U.S. gas wells (~480,000 wells) are liquid loaded. The challenge is that large remaining reserve potential with lower per well revenue stream are needed to justify the price of installing traditional artificial lift technologies.

The second major shortcoming of the existing artificial lift technologies is the lack of design for dealing with three phase flow, with the largest percentage being the gas phase. For example, many conventional artificial lift pumps gas lock or cavitate when pumping fluids comprising more than about 30% gas by volume. However, in may gas wells, the pump may experience churn fluid flow where the pump intake may experience transitions between 100% gas and 100% liquid over a few seconds. In general, the goal of a downhole fluid pump is to physically lower the fluid level or hydrostatic in the wellbore as close to the pump intake as possible. Unfortunately, most conventional artificial lift technologies cannot achieve this goal and thus are not fit for purpose.

With well economics driving limited choices for deliquification, one lower cost option that has been investigated is called "plunger lift." In a plunger lift system, a solid round metal plug is placed inside the tubing at the bottom of the well, and liquids are allowed to accumulate on top of the plug. Then a controller shuts in the well via a shutoff valve and allows pressure to build and then releases the plunger to come to surface, pushing the fluids above it. When the shutoff valve is closed, the pressure at the bottom of the well usually builds up slowly over time as fluids and gas pass from the formation into the well. When the shutoff valve is opened, the pressure at the well head is lower than the bottomhole pressure, so that the pressure differential causes the plunger to travel to the surface. Plunger lift is basically a cyclic "bucketing" of fluids to surface. Since the driver is the wellbore pressure it is directly proportional to the amount of liquid it can lift. Also, the older the well, the longer shut-in times are required to build pressure. Besides the safety risks of launching a metal plug to surface at velocities around 1,000 feet per minute, the plunger requires high manual intervention and only removes a small fraction of the liquid column to surface.

Accordingly, there remains a need in the art for economical methods and systems for deliquifying wells having low volume of liquid.

BRIEF SUMMARY OF THE DISCLOSURE

These and other needs in the art are addressed in one embodiment by a deliquification pump for deliquifying a well. In an embodiment, the deliquification pump comprises a fluid end pump adapted to pump a fluid from a wellbore. In addition, the deliquification pump comprises a hydraulic pump adapted to drive the fluid end pump. The hydraulic pump having a central axis and including a housing having a first internal pump chamber and a first pump assembly disposed in the first chamber. The first pump assembly includes a piston adapted to reciprocate axially relative to the housing. The piston has a first end, a second end opposite the first end, and a throughbore extending between the first end and the second end. Further, the first pump assembly includes a first wobble plate including a planar end face axially adjacent the second end of the piston and a slot extending axially through the first wobble plate. The slot is disposed at a uniform radius from the central axis and the end face is oriented at an acute angle relative to the central axis. The first wobble plate is adapted to rotate about the central axis relative to the housing to axially reciprocate the piston and cyclically place the throughbore of the piston in fluid communication with the slot.

These and other needs in the art are addressed in another embodiment by a system for deliquifying a wellbore. In an embodiment, the system comprises a downhole deliquification pump coupled to a lower end of a tubing string. The downhole deliquification pump has a longitudinal axis and includes a pump inlet and a pump outlet. In addition, the deliquification pump includes a fluid end pump adapted to pump a fluid through the pump outlet to the surface through the tubing string. Further, the deliquification pump includes a hydraulic pump coupled to the fluid end pump and adapted to power the fluid end pump. Still further, the deliquification pump includes an electric motor coupled to the hydraulic pump and adapted to power the hydraulic pump. The system also includes a conduit in fluid communication with the pump inlet and extending axially through the electric motor and the hydraulic pump to the fluid end pump. The conduit is adapted to supply the fluid to the fluid end pump.

These and other needs in the art are addressed in another embodiment by a method for deliquifying a well. In an embodiment, the method comprises (a) positioning a deliquification pump into a wellbore with a tubing string. The deliquification pump comprises a fluid end pump, a hydraulic pump coupled to the fluid end pump, and an electric motor coupled to the hydraulic pump. In addition, the method comprises (b) powering the fluid end pump with the hydraulic pump. Further, the method comprises (c) powering the hydraulic pump with the electric motor. Still further, the method comprises (d) sucking well fluids into the separator. The well fluids include a liquid phase and a plurality of solid particles disposed in the liquid phase. Moreover, the method comprises (e) separating at least a portion of the solid particles from the liquid phase to generate processed well fluids. The method also comprises (f) flowing the processed well fluids to the fluid end pump. In addition, the method comprises (g) pumping the processed well fluids to the surface with the fluid end pump.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
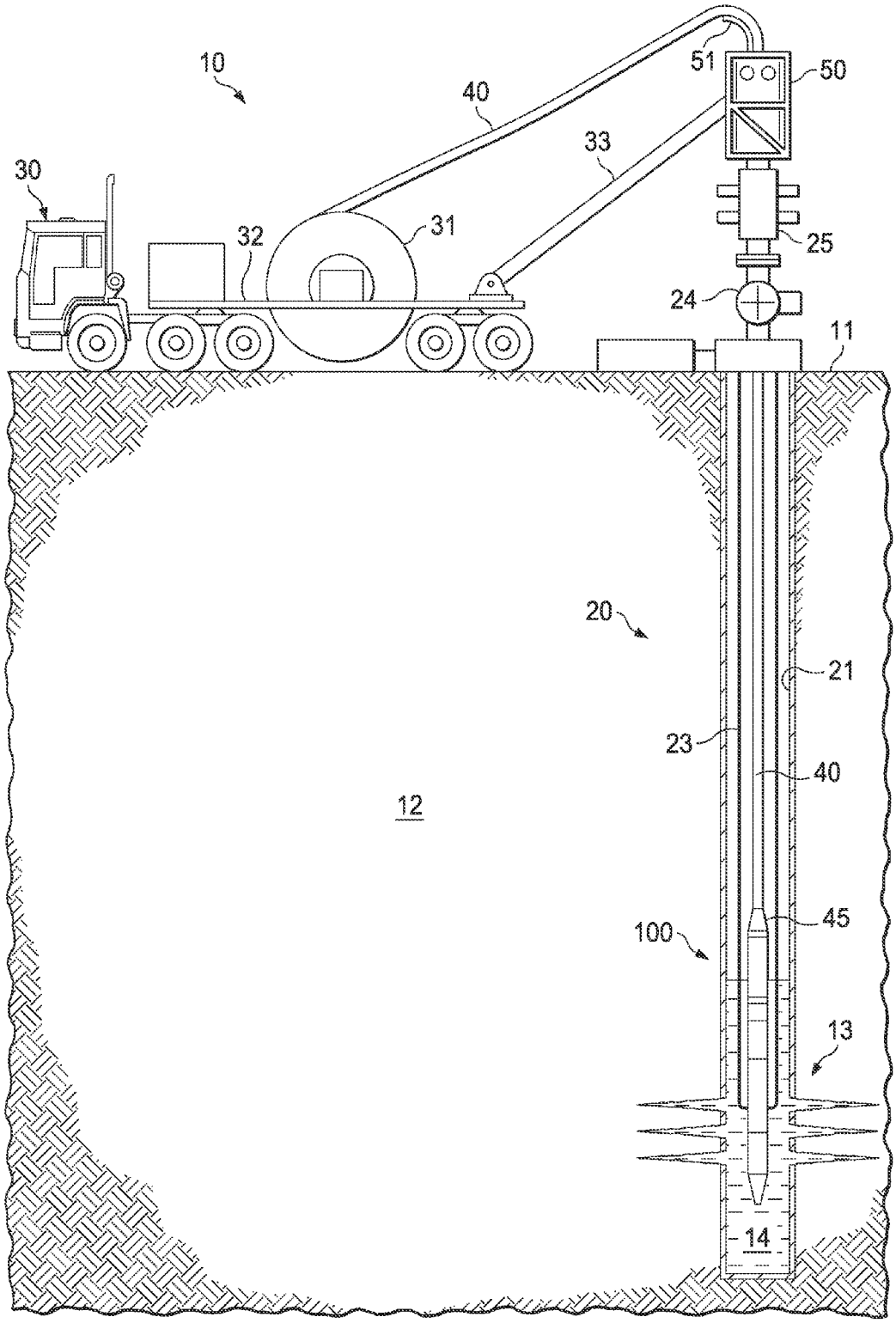
FIG. 1 is a schematic view of an embodiment of a rigless system for deliquifying a hydrocarbon producing well.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of a rigless deliquification system 10 for deliquifying a hydrocarbon producing wellbore 20 is shown. In this embodiment, system 10 includes a mobile deployment vehicle 30 at the surface 11, spoolable or coiled tubing 40, an injector head 50, and a deliquification pump 100. Deployment vehicle 30 has a spool or reel 31 for storing, transporting, and deploying spoolable tubing 40. Specifically, tubing 40 is a long, continuous length of pipe wound on reel 31. Tubing 40 is straightened prior to being pushed into wellbore 20 and rewound to coil tubing 40 back onto reel 31. Deliquification pump 100 is coupled to the lower end of spoolable tubing 40 with a connector 45 and is controllably positioned in wellbore 20 with tubing 40.

Wellbore 20 traverses an earthen formation 12 comprising a production zone 13. Casing 21 lines wellbore 20 and includes perforations 22 that allow fluids 14 (e.g., water, gas, etc.) to pass from production zone 13 into wellbore 20. In this embodiment, production tubing 23 extends from a wellhead 24 through wellbore casing 21. System 10 extends into wellbore 20 through an injector head 50 coupled to a wellhead 24 and production tubing 23. In this embodiment, a blowout preventer 25 sits atop wellhead 24, and thus, system 10 extends through injector head 50, blowout preventer 25, and wellhead 24 into production tubing 23.

As shown in FIG. 1, deployment vehicle 30 is parked adjacent to wellhead 24 at the surface 11. Deliquification pump 100 is coupled to tubing 40 and lowered into wellbore 20 by controlling reel 31. In general, pump 100 may be coupled to spoolable tubing 40 before or after passing spoolable tubing 40 through injector head 50, BOP 25, and wellhead 21. Tubing 40 is unreeled until deliquification pump 100 is positioned at the bottom of wellbore 20. Using spoolable tubing 40, pump 100 may be deployed to depths in excess of 3,000 ft., and in some cases, depths in excess of 8,000 ft. or even 10,0000 ft. Accordingly, pump 100 is preferably designed to withstand the harsh downhole conditions at such depths.

During deliquification operations, fluids 14 in the bottom of wellbore 20 are pumped through tubing 40 to the surface 11 with pump 100. In general, system 10 may be employed to lift and remove fluids from any type of well including, without limitation, oil producing wells, natural gas producing wells, methane producing wells, propane producing wells, or combinations thereof. However, embodiments of system 10 described herein are particularly suited for deliquification of gas wells. In this embodiment, wellbore 20 is gas well, and thus, fluids 14 include water, hydrocarbon condensate, gas, and possibly small amounts of oil. Pump 100 may remain deployed in well 20 for the life of the well 20, or alternatively, be removed from well 20 once production of well 20 has been re-established.

It should be appreciated that deployment of system 10 and deliquification pump 100 via vehicle 30 eliminates the need for construction and/or use of a rig. In other words, system 10 and pump 100 may be deployed in a "rigless" manner. As used herein, the term "rigless" is used to refer to an operation, process, apparatus or system that does not require the construction or use of a workover rig that includes the derrick or mast, and the drawworks. By eliminating the need for a workover rig for deployment, system 10 offers the potential to provide a more economically feasible means for deliquifying relatively low production gas wells.

Referring still to FIG. 1, in this embodiment, rigless deployment vehicle 30 is a mobile unit capable of transporting system 10 from site-to-site on roads and highways. In particular, rigless deployment vehicle 30 is a truck including a trailer 32 and mast 33. Reel 31 is rotatably mounted to trailer 32, and mast 33 is rotatably and pivotally coupled to trailer 32. Injector head 50 is coupled to the distal end of mast 33 and is positioned atop wellhead 20 with mast 33. In this embodiment, injector head 50 includes a gooseneck 51 that facilitates the alignment of tubing 40 with injector head 50 and wellhead 24. The rotation of reel 31 and positioning of mast 33 may be powered by any suitable means including, without limitation, an internal combustion engine (e.g., the engine of truck 30), an electric motor, a hydraulic motor, or combinations thereof. Since vehicle 30 is designed to travel existing highways and roads, vehicle 30 preferably does not exceed 13.5 feet in height. Examples of suitable rigless deployment vehicles that may be employed as vehicle 30 are described in U.S. Pat. Nos. 6,273,188, and 7,182,140, each of which are hereby incorporated herein by reference in their entireties for all purposes.

Figure 2:
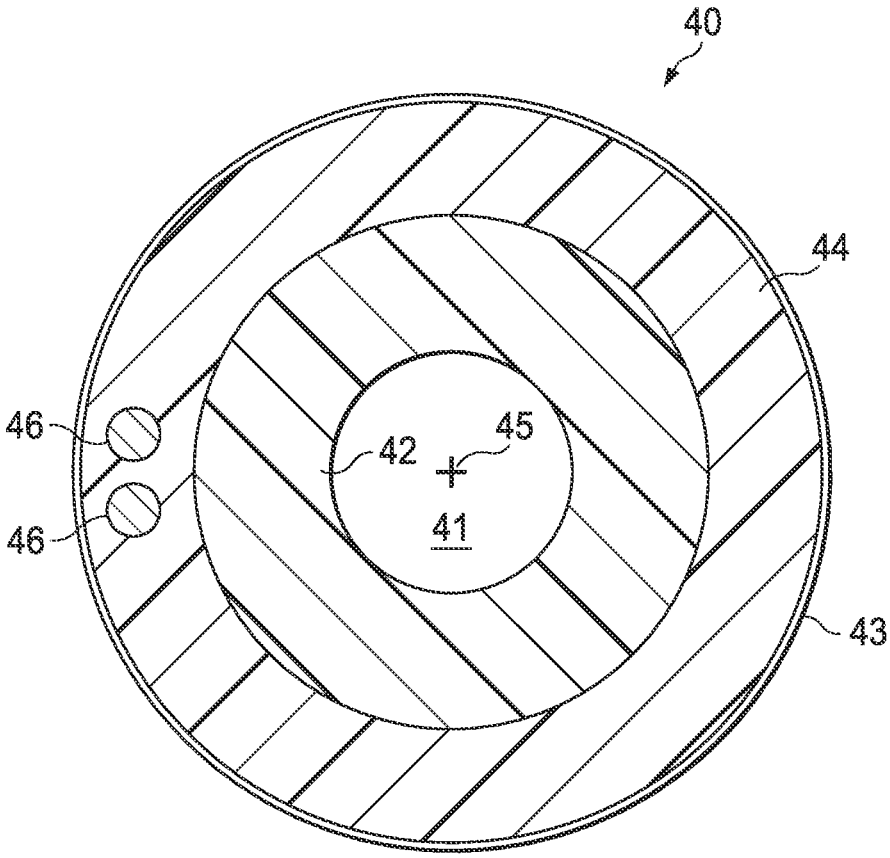
FIG. 2 is a cross-sectional view of the spoolable tubing of FIG. 1.

As previously described, spoolable tubing 40 is used to deploy and position pump 100 downhole. In general, tubing 40 may comprise any suitable tubing capable of being spooled and stored on reel 31 including, without limitation, coiled steel tubing or spoolable composite tubing. As best shown in FIG. 2, in this embodiment, spoolable tubing 40 is composite tubing having a central or longitudinal axis 45, a central throughbore 41, a radially inner fluid impermeable layer 42, an radially outer layer 43, and an intermediate layer 44 radially positioned between layers 42, 43. In addition, tubing 40 includes a plurality of energy conductors or wires 46 that provide electrical power from the surface 11 to deliquification pump 100. In this embodiment, wires 46 are embedded in intermediate layer 44, however, in general, the conductors (e.g., wires 46) may be embedded in any suitable portion of the composite coiled tubing (e.g., embedded within inner layer 42).

In this embodiment, inner layer 42 and intermediate layer 44 are melt fused together to form a virtually seamless bond therebetween. Thus, inner layer 42 and intermediate layer 44 are preferably made from polymeric materials capable of being melt fused together to form a seamless bond. Examples of suitable polymeric materials for layers 42, 44 include, without limitation, polyethylene, polypropylene, high density polyethylene (HDPE), low density polyethylene (LDPE), copolymers, block copolymers, polyolefins, polycarbonates, polystyrene, or combinations thereof. Although inner layer 42 and intermediate layer 44 are made from the same polymeric material in this embodiment, in other embodiments, inner layer 42 and intermediate layer 44 may be made of different polymeric materials. Further, inner layer 42 may be fiber reinforced.

Intermediate layer 44 may comprise fiber impregnated polymeric tape that is repeatedly wrapped around and melt fused to inner layer 42. In general, the fibers impregnated within the polymeric tape may be made of any suitable material including, without limitation, glass fibers, polymer fibers, carbon fibers, combinations thereof, and the like. The fiber impregnated tape may be wrapped at different angles to modulate or adjust the tensile strength of composite coiled tubing 40.

Since inner layer 42 and intermediate layer 44 are melt fused together, no epoxy or additional compounds are necessary to secure or bond layers, 42, 44 together. As a result, layered composite tubing 40 is solid wall tubing with a relatively high collapse pressure rating. The solid wall technology offers the potential to eliminate gas migration as compared to epoxy based tubing that often develops micro cracks from bending. In particular, composite coiled tubing (e.g., tubing 40) offers the potential for enhanced ductility as compared to epoxy bonded tubing. For example, embodiments of coiled tubing 40 may withstand over 18,000 bend cycles. For use in harsh downhole conditions, spoolable tubing 40 is preferably capable of withstanding temperatures (i.e. temperature rated) of at least about 200° F., and more preferably capable of withstanding temperatures of at least about 250 to 300° F.

As previously described, in this embodiment, spoolable tubing 40 comprises inner layer 42 and intermediate layer 44 preferably made from polymeric that are melt fused together. However, in general, the spoolable tubing (e.g., tubing 40) may be made from any suitable type of spoolable tubing including steel coiled tubing, composite reinforced spoolable tubing, etc. For example, the spoolable tubing may comprise an inner layer (e.g., layer 42) and an intermediate layer (e.g., layer 44) made of high temperature flexible epoxy. Moreover, although this embodiment of system 10 includes spoolable tubing 40, pump 100 may also be delivered downhole with conventional jointed oilfield tubing or pipe joints with one or more conductors strapped to the string or integral with the string (e.g., wire pipe).

Figure 3:
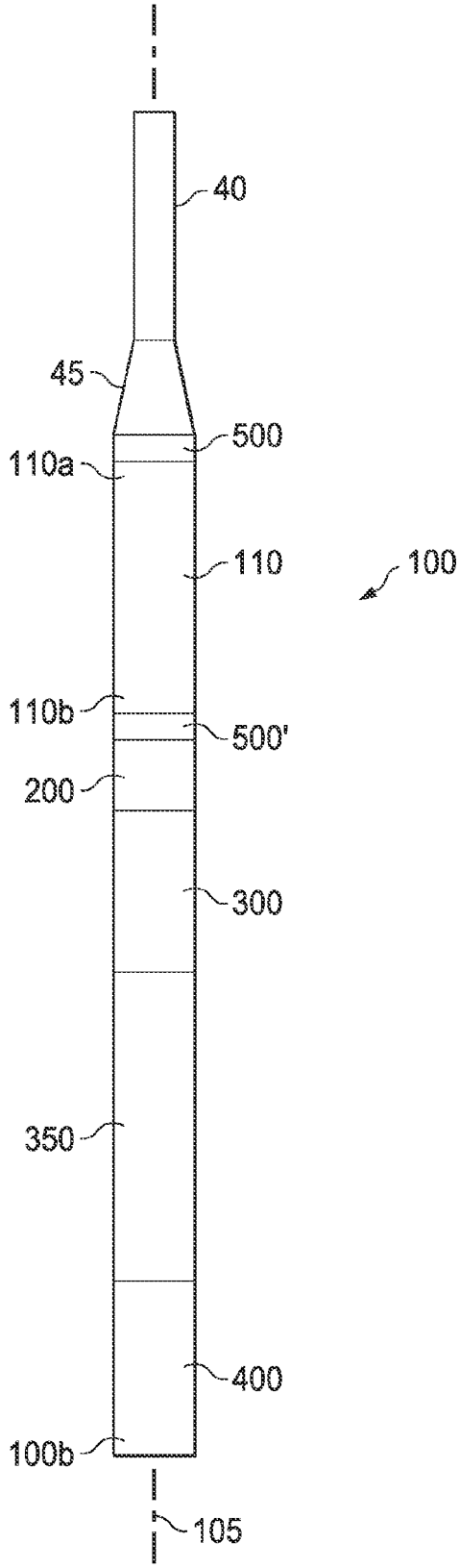
FIG. 3 is a schematic front view of the deliquification pump of FIG. 1.

Referring now to FIG. 3, deliquification pump 100 is hung from tubing 40 via connector 45 and has a central or longitudinal axis 105, a first or upper end 100*a* coupled to connector 45, and a second or lower end 100*b* distal connector 45 and tubing 40. Moving axially from upper end 100*a* to lower end 100*b*, in this embodiment, pump 100 includes a fluid end pump 110, a hydraulic pump 200, an electric motor 300, a compensator 350, and a separator 400 coupled together end-to-end. Fluid end pump 110, hydraulic pump 200, motor 300, compensator 350, and separator 400 are coaxially aligned, each having a central axis coincident with pump axis 105.

Figure 4A:
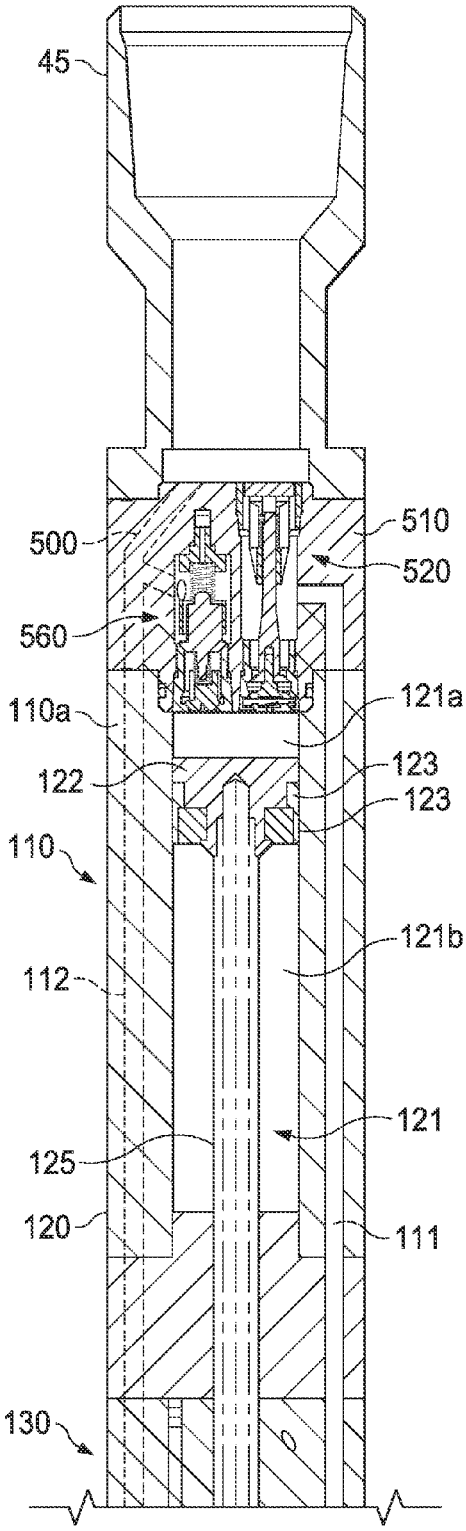
FIGS. 4A-4G are cross-sectional views of successive portions of the deliquification pump of FIG. 3.
Figure 4B:
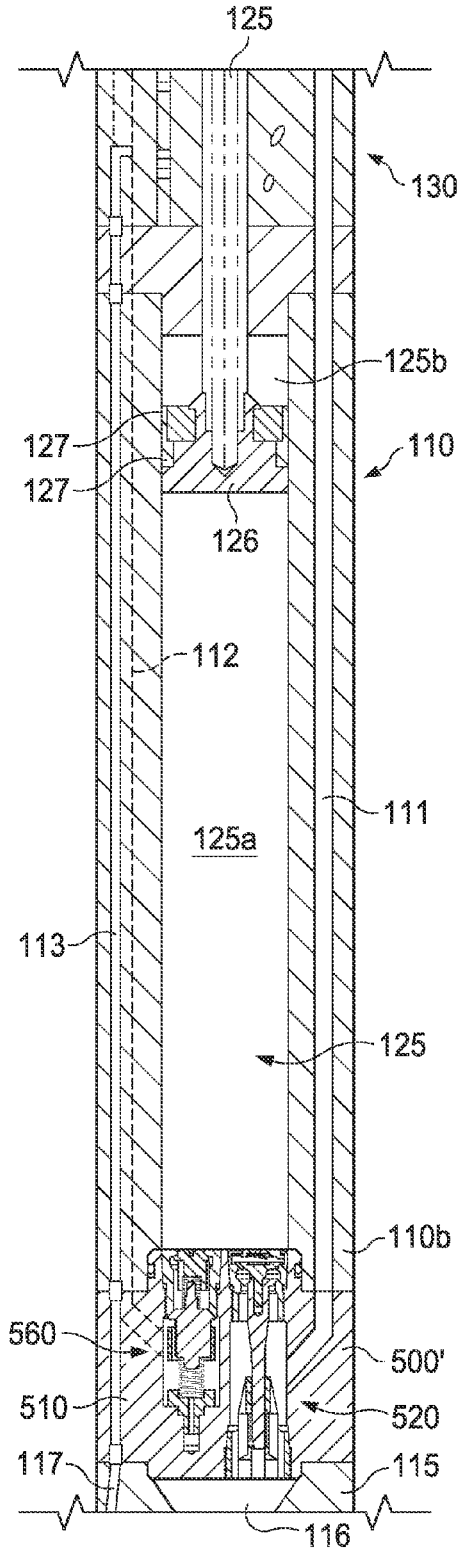
Figure 4C:
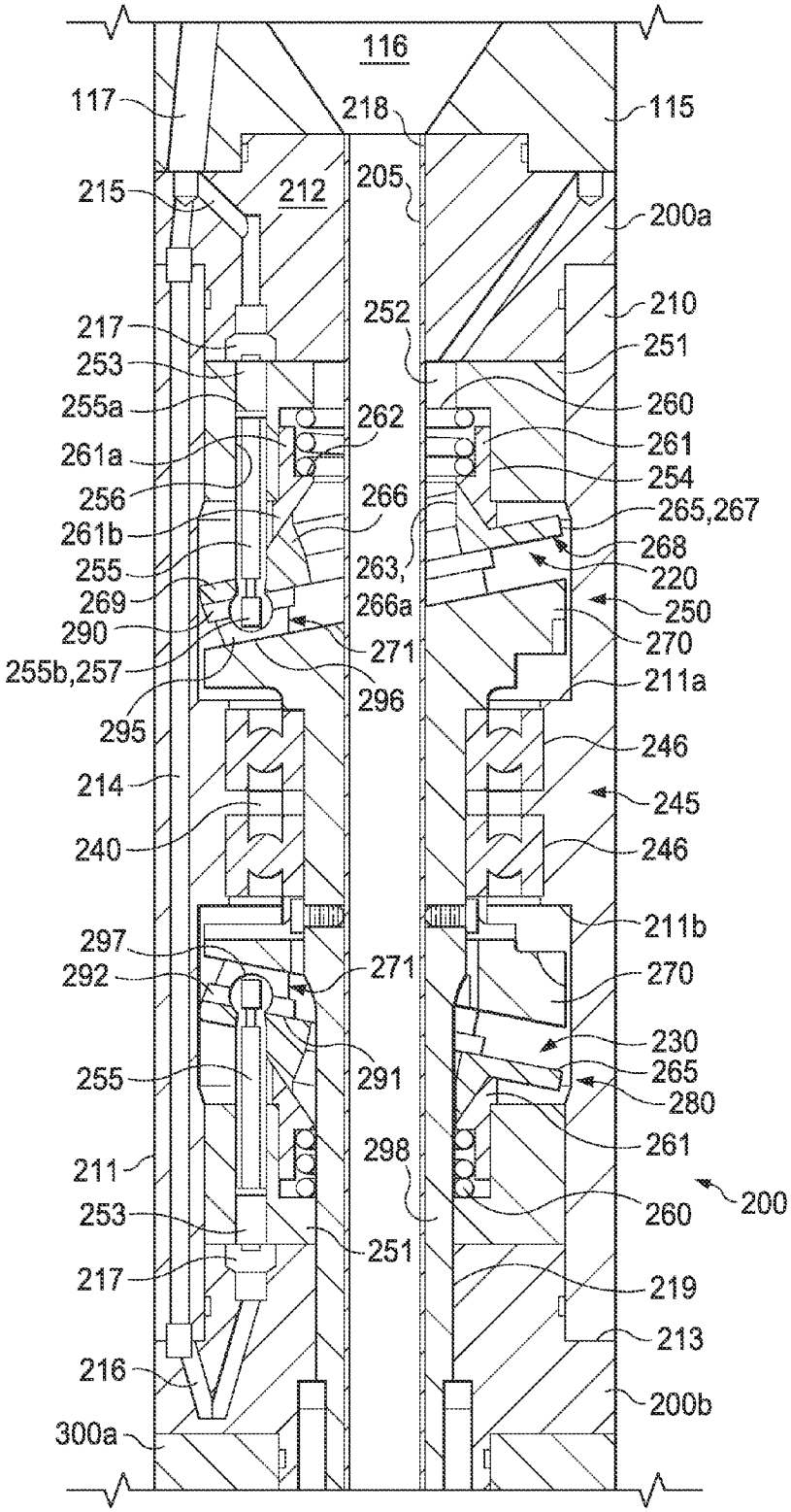
Figure 4D:
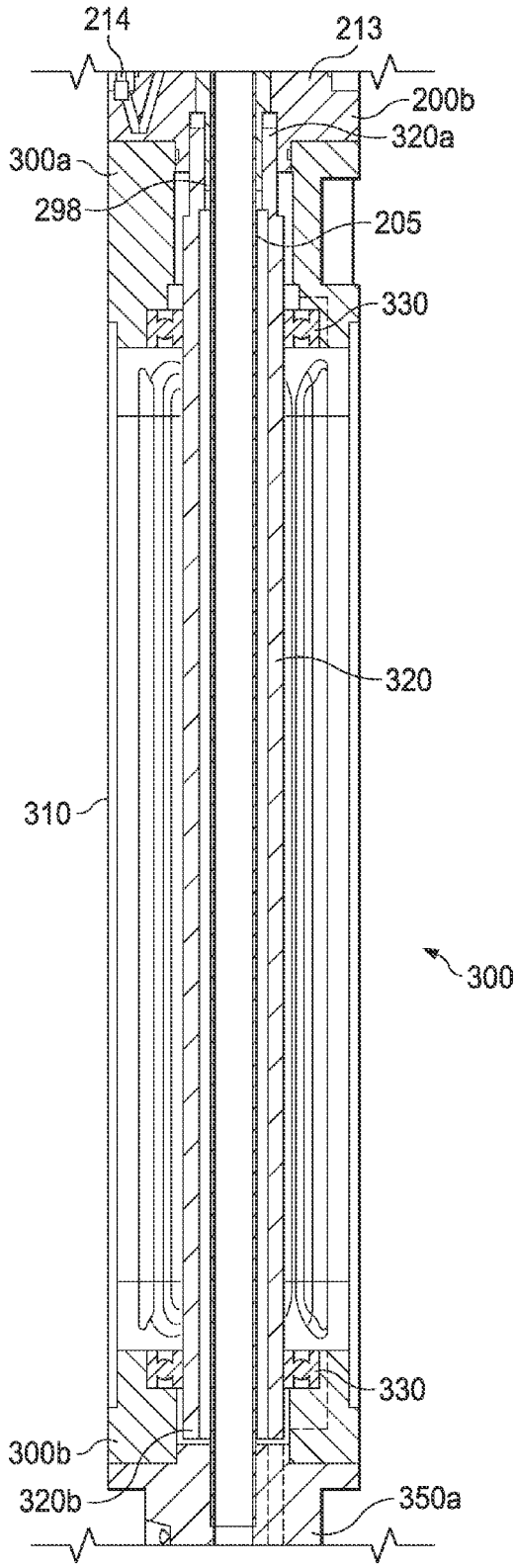
Figure 4E:
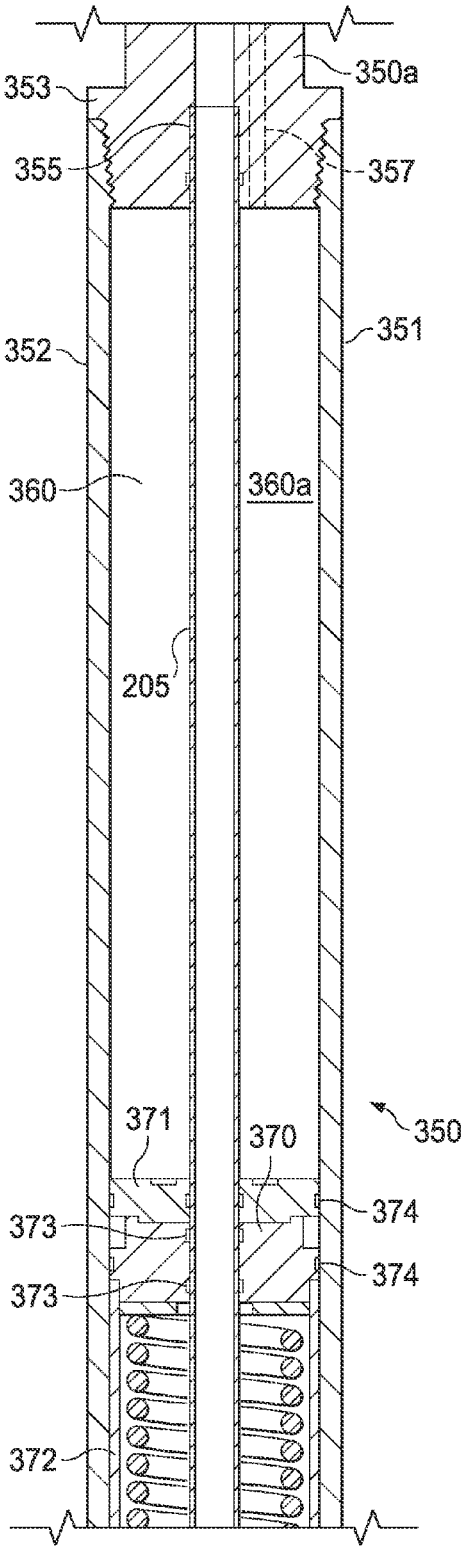
Figure 4F:
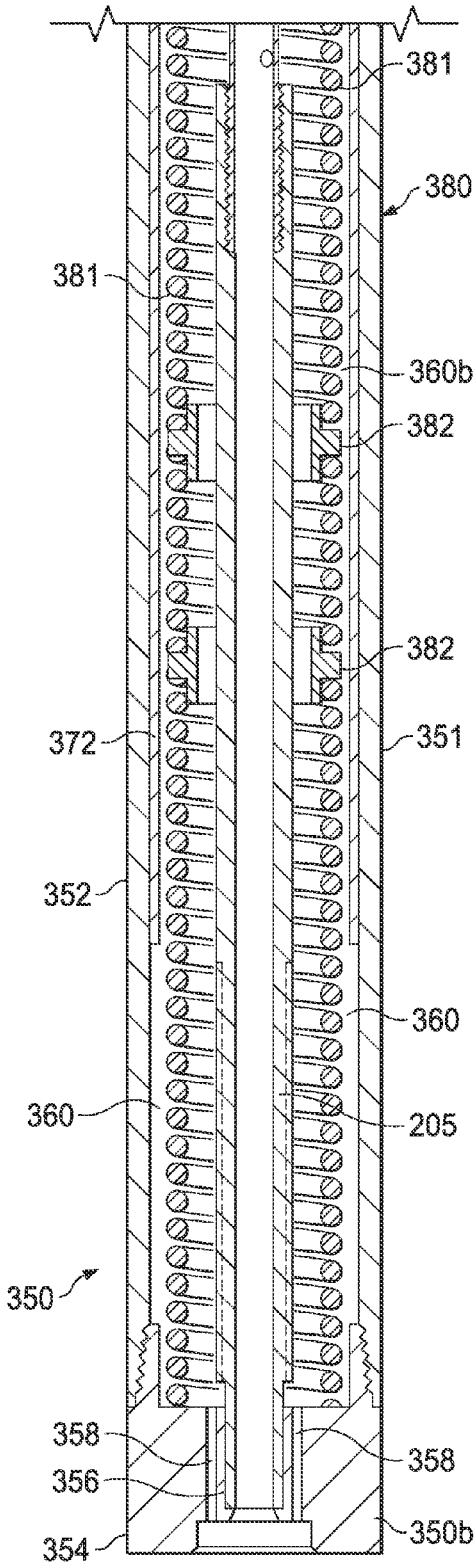
Figure 4G:
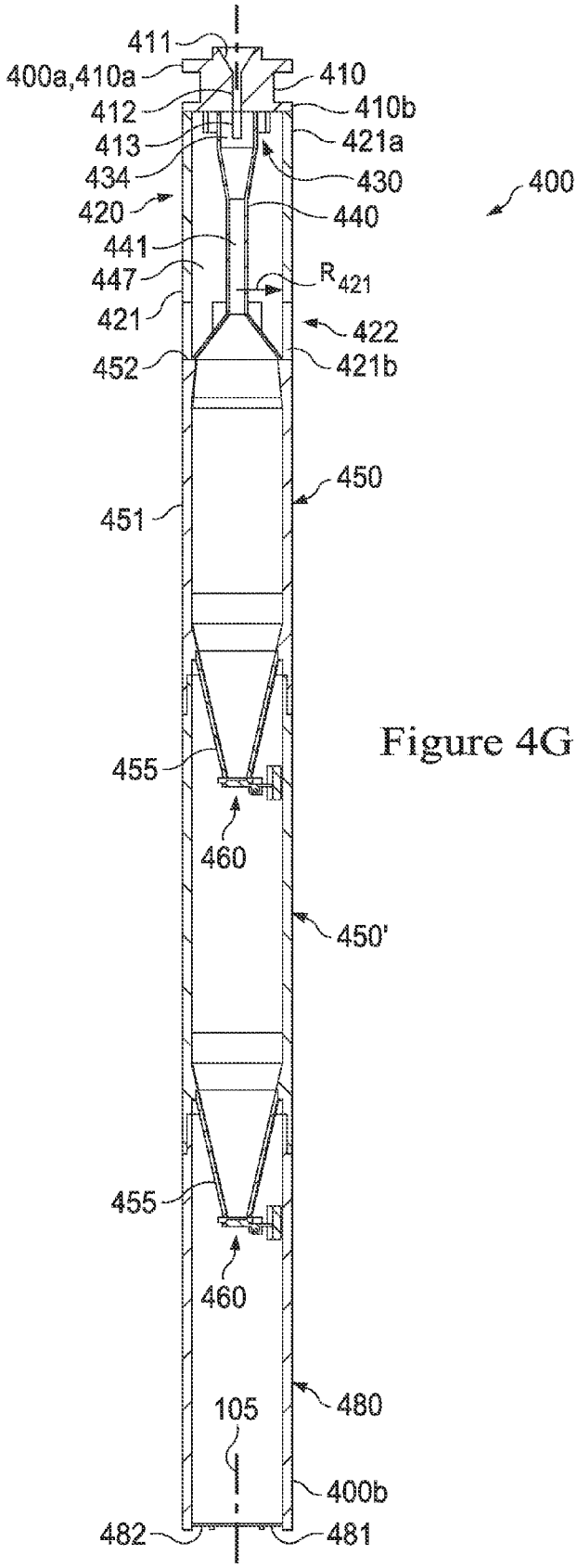

Due to the length of deliquification pump 100, it is illustrated in seven longitudinally broken sectional views, vis-à-vis FIGS. 4A-4G. The sections are arranged in sequential order moving along pump 100 from FIG. 4A to FIG. 4G and are generally divided between the different components of pump 100. Namely, FIGS. 4A and 4B illustrate fluid end pump 110, FIG. 4C illustrates hydraulic pump 200, FIG. 4D illustrates electric motor 300, FIGS. 4E and 4F illustrate compensator 350, and FIG. 4G illustrates separator 400. Although FIG. 3 illustrates one exemplary order for stacking the components of deliquification pump 100 (i.e., fluid end pump 110 disposed above hydraulic pump 200, hydraulic pump 200 disposed above electric motor 300, electric motor 300 disposed a compensator 350, and compensator 350 disposed above separator 400), it should be appreciated that in other embodiments, the components of the deliquification pump (e.g., fluid end pump 110, hydraulic pump 200, electric motor 300, compensator 350, and separator 400 of deliquification pump 100) may be arranged in a different order. For example, the separator (e.g., separator 400) could be positioned at or proximal the upper end of the deliquification pump (e.g., at or near upper end 100*a* of pump 100).

Although components of deliquification pump 100 may be configured differently, the basic operation of pump 100 remains the same. In particular, fluid 14 in wellbore 20 enters separator 400, which separates solids (e.g., sand, rock chips, etc.) from well fluid 14 to form a solids-free or substantially solids-free fluid 15, which may also be referred to as "clean" fluid 15. Clean fluid 15 output from separator 400 is sucked into fluid end pump 110 and pumped to the surface 11 through coupling 45 and tubing 40. Fluid end pump 110 is driven by hydraulic pump 200, which is driven by electric motor 300. Conductors 46 provide electrical power downhole to motor 300. Compensator 350 provides a reservoir for hydraulic fluid, which can flow to and from hydraulic pump 200 and motor 300 as needed. Deliquification pump 100 is particularly designed to lift substantially solids-free fluid 15, which may include liquid and gaseous phases (e.g., water and gas), in wellbore 20 to the surface 11 in the event the gas pressure in wellbore 20 is insufficient to remove the liquids in fluid 14 to the surface 11 (i.e., wellbore 20 is a relatively low pressure well). As will be described in more detail below, use of hydraulic pump 200 in conjunction with fluid end pump 110 offers the potential to generate the relatively high fluid pressures necessary to force or eject relatively low volumes of well fluids 15 to the surface 11.

Referring now to FIGS. 3, 4A, and 4B, fluid end pump 110 has a first or upper end 110*a*, a second or lower end 110*b*, and, in this embodiment, comprises is a double acting reciprocating pump. In particular, fluid end pump 110 includes a radially outer pump housing 120 extending between ends 110*a, b*, a first or upper piston chamber 121 disposed within housing 120 and extending axially from end 110*a*, a second or lower piston chamber 125 disposed within housing 120 and extending axially from end 110*b*, and a shuttle valve assembly 130 axially positioned between chambers 121, 125. In this embodiment, housing 120 is formed from a plurality of tubular segments joined together end-to-end with mating box-pin end threaded connections. Consequently, housing 120 is modular and may be broken down apart into various subcomponents as necessary for maintenance or repair (e.g., replacement of piston seals, etc.).

Fluid end pump 110 also includes a first or upper piston 122 slidingly disposed in first chamber 121 and a second or lower piston 126 slidingly disposed in second chamber 122. Pistons 122, 126 are connected by an elongate connecting rod 125 that extends axially through shuttle valve assembly 130. A first or upper well fluids control valve assembly 500 is coupled to end 110*a* of housing 110, and a second or lower well fluids control valve assembly 500' is coupled to end 110*b* of housing 110. As will be described in more detail below, valve assemblies 500, 500' are substantially the same. In particular, each valve assembly 500, 500' includes a valve body 510, a well fluids inlet valve 520, and a well fluids outlet valve 560.

Piston 122 divides upper chamber 121 into two sections or subchambers—a well fluids section 121*a* axially positioned between upper valve assembly 500 and piston 122, and a hydraulic fluid chamber 121*b* axially positioned between piston 122 and shuttle valve assembly 130. Likewise, piston 126 divides lower chamber 125 into two sections or subchambers—a well fluids section 125*a* axially positioned between lower valve assembly 500' and piston 126, and a hydraulic fluid chamber 125*b* axially positioned between piston 125 and shuttle valve assembly 130. Together, housing 110, piston 122, and valve assembly 500 define section 121*a*, and together, housing 110, piston 126, and valve assembly 500' define section 125*a*. In general, inlet valve 520 of valve assemblies 500, 500' control the flow of well fluids 15 into chamber sections 121*a*, 125*a*, respectively, and outlet valve 560 of valve assemblies 500, 500' control the flow of well fluids out of chamber sections 121*a*, 125*a*, respectively.

Referring still to FIGS. 4A and 4B, fluid end pump 110 also includes a well fluids inlet conduit or passage 111, a well fluids outlet conduit or passage 112, and a hydraulic fluid conduit or passage 113, each passage 111, 112, 113 extending through housing 120. Passages 111, 112, 113 are circumferentially spaced from each other about axis 105. In this embodiment, passage 113 circumferentially spaced from the cross-sectional plane, and thus, is shown with dashed, hidden lines in FIGS. 4A and 4B. Substantially solids-free well fluids 15 are output from separator 400 and flow through a well fluids conduit 116 in a distributor 115 coupled to lower valve assembly 500'. Inlet valve 520 of lower valve assembly 500' is in fluid communication with well fluids conduit 116. Thus, separator 400 supplies well fluids 15 to inlet valve 520 of lower valve assembly 500' via well fluids conduit 116. In addition, inlet passage 111 extends between and is in fluid communication with inlet valve 520 of lower valve assembly 500' and inlet valve 520 of upper valve assembly 500. Thus, well fluids 15 from separator 400 flow through well fluids conduit 116, inlet valve 520 of lower valve assembly 500', and inlet passage 111 to inlet valve 520 of upper valve assembly 500. In other words, well fluids conduit 116 supplies well fluids 15 to inlet valve 520', and inlet passage 111 supplies well fluids 15 from well fluids conduit 116 and inlet valve 520' to inlet valve 520.

Outlet passage 112 is in fluid communication with tubing 40 (via coupling 45), outlet valve 560 of upper valve assembly 500, and outlet valve of lower valve assembly 500'. Thus, outlet passage 112 places both outlet valves 560 in fluid communication with tubing 40. Outlet valves 560 of valve assemblies 500, 500' control the flow of well fluids out of chamber sections 121*a*, 125*a*, respectively. As will be described in more detail below, well fluids 15 are pumped by fluid end pump 110 from chamber sections 121*a*, 125*a* through outlet valves 560, outlet passage 112, and tubing 40 to the surface 11.

Hydraulic fluid passage 113 is in fluid communication with hydraulic pump 200 and shuttle valve assembly 130. In particular, hydraulic pump 200 provides compressed hydraulic fluid to shuttle valve assembly 130 via passage 113. Shuttle valve assembly 130 includes a stroke sensor and plurality of valves and associated flow passages that reciprocally distribute the flow of the compressed hydraulic fluid to hydraulic fluid chambers 121*b*, 125*b*, thereby driving the axial, reciprocal motion of pistons 122, 126. The stroke sensor ensures controlled switching of the supply of hydraulic fluid among the valves and flow passages. In general, shuttle valve assembly 130 may comprise any suitable shuttle valve that reciprocally alternates the flow of compressed hydraulic fluid between two distinct and separate chambers. Examples of suitable shuttle valves are disclosed in U.S. Pat. No. 4,597,722 which is hereby incorporated herein by reference in its entirety for all purposes.

A pair of annular seals 123, 127 are disposed about each piston 122, 126, respectively, and sealingly engages piston 122, 126, respectively, and housing 120. In particular, each seal 123, 127 forms a dynamic seal with housing 120 and a static seal with piston 122, 126, respectively. Seals 123, 127 restrict and/or prevent fluid communication between well fluids 15 in chambers 121*a*, 125*a*, respectively, and hydraulic fluid in sections 121*b*, 125*b*, respectively. It should be appreciated that over time, small amounts of hydraulic fluid may leak or seep past seals 123, 127 from sections 121*b*, 125*b*, respectively, to sections 121*a*, 125*a*, respectively. However, as will be described in more detail below, compensator 350 functions as a hydraulic fluid reservoir to compensate for any lost hydraulic fluid.

During pumping operations, hydraulic pump 200 provides compressed hydraulic fluid to shuttle valve assembly 130 via fluid passage 113. Shuttle valve assembly 130 controls the flow of compressed hydraulic fluid into chambers 121*b*, 125*b* to drive the axial reciprocal motion of pistons 122, 126 in chambers 121, 125, respectively. Namely, shuttle valve assembly 130 provides compressed hydraulic fluid to sections 121*b*, 125*b* in a reciprocating or alternating fashion, and allows fluid to exit sections 125*b*, 121*b*, respectively, in a reciprocating or alternating fashion. As shuttle valve assembly 130 supplies compressed hydraulic fluid to chamber 121*b*, piston 122 is urged axially upward within chamber 121 towards upper valve assembly 500, thereby increasing the volume of section 121*b* and decreasing the volume of section 121*a*. Since pistons 122, 126 are connected by connecting rod 125, pistons 122, 126 move axially together. Thus, when piston 122 is urged axially upward within chamber 121, piston 126 is also urged axially upward within chamber 125, thereby decreasing the volume of section 125*b* and increasing the volume of section 125*a*. Simultaneous with directing compressed hydraulic fluid to chamber 121*b*, shuttle valve assembly 130 allows hydraulic fluid to exit section 125*b*, thereby allowing the volume of section 125*b* to decrease without restricting the axial movement of pistons 122, 126.

The upward axial movement of pistons 122, 126 continues as compressed hydraulic fluid is supplied to chamber 121*b* until piston 122 is proximal upper valve assembly 500 and the volume of section 121*a* is at its minimum. At this point, piston 122 may be described as being at the axially outermost end of its stroke relative to shuttle valve assembly 130 (i.e., its furthest axial position from shuttle valve assembly 130), and piston 126 may be described as being at the axially innermost end of its stroke relative to shuttle valve assembly 130 (i.e., its closest axial position to shuttle valve assembly 130). In this embodiment, fluid end pump 110 and upper valve assembly 500 are sized and configured to minimize the dead or unswept volume in section 121*a* when piston 122 is at the outermost end of its stroke. In embodiments, described herein, the volume of section 121*a* when piston 122 is at the outermost end of its stroke (i.e., the unswept volume of section 121*a*) is close to zero.

Referring still to FIGS. 4A and 4B, simultaneous with piston 122 achieving the axially outermost end of its stroke (i.e., its closest position to upper valve assembly 500), shuttle valve assembly 130 stops supplying compressed hydraulic fluid to chamber 121*b*, and begins supplying compressed hydraulic fluid to chamber 125*b*. As compressed hydraulic fluid flows into chamber 125*b*, piston 126 is urged axially downward within chamber 125 towards lower valve assembly 500', thereby increasing the volume of section 125*b* and decreasing the volume of section 125*a*. Since pistons 122, 126 are connected by connecting rod 125, as piston 126 is urged axially downward within chamber 125, piston 122 is also urged axially downward within chamber 121, thereby decreasing the volume of section 121*b* and increasing the volume of section 121*a*. Simultaneous with directing compressed hydraulic fluid to chamber 125*b*, shuttle valve assembly 130 allows hydraulic fluid to exit section 121*b*, thereby allowing the volume of section 121*b* to decrease without restricting the axial movement of pistons 122, 126.

The downward axial movement of pistons 122, 126 continues as compressed hydraulic fluid is supplied to chamber 125*b* until piston 126 is proximal lower valve assembly 500' and the volume of section 125*a* is at its minimum. At this point, piston 126 may be described as being at the axially outermost end of its stroke relative to shuttle valve assembly 130 (i.e., its furthest axial position from shuttle valve assembly 130), and piston 122 may be described as being at the axially innermost end of its stroke relative to shuttle valve assembly 130 (i.e., its closest axial position to shuttle valve assembly 130). In this embodiment, fluid end pump 110 and lower valve assembly 500' are sized and configured to minimize the dead or unswept volume in section 125*a* when piston 126 is at the outermost end of its stroke. In embodiments, described herein, the volume of section 125*a* when piston 126 is at the outermost end of its stroke (i.e., the unswept volume of section 125*a*) is close to zero. Simultaneous with piston 126 achieving the axially outermost end of its stroke (i.e., its closest position to upper valve assembly 500), shuttle valve assembly 130 stops supplying compressed hydraulic fluid to chamber 125*b*, begins supplying compressed hydraulic fluid to chamber 121*b*, and the process repeats. In the manner previously described, pistons 122, 126 are axially reciprocated within chambers 121, 125 by reciprocating the flow of compressed hydraulic fluid into sections 121*b*, 125*b*.

As previously described, as pistons 122, 126 move axially upward within chambers 121, 125, respectively, the volume of section 121*a* decreases, and the volume of section 125*a* increases. As the volume of section 121*a* decreases, the pressure of well fluids 15 therein increases, and as the volume of section 125*a* increases, the pressure of well fluids 15 therein decreases. When the pressure in section 121*a* is sufficiently large, outlet valve 560 of upper valve assembly 500 transitions to an "open position," thereby allowing well fluids to flow from section 121*a* to tubing 40 via outlet passage 112 and coupling 45; and when the pressure in section 125*a* is sufficiently low, inlet valve 520 of lower valve assembly 500' transitions to an "open position," thereby allowing well fluids to flow into section 125*a* from well fluids conduit 116. As will be described in more detail below, each valve assembly 500, 500' is designed such that outlet valve 560 is closed when its corresponding inlet valve 520 is open, and inlet valve 520 is closed when its corresponding outlet valve 560 is open.

Conversely, as pistons 122, 126 move axially downward within chambers 121, 125, respectively, the volume of section 121*a* increases, and the volume of section 125*a* decreases. As the volume of section 121*a* increases, the pressure of well fluids 15 therein decreases, and as the volume of section 125*a* decreases, the pressure of well fluids 15 therein increases. When the pressure in section 121*a* is sufficiently low, inlet valve 520 of upper valve assembly 500 transitions to an "open position," thereby allowing well fluids to flow into section 121*a* from inlet passage 111; and when the pressure in section 125*a* is sufficiently high, outlet valve 560 of lower valve assembly 500' transitions to an "open position," thereby allowing well fluids to flow from section 125*a* to tubing 40 via outlet passage 112 and coupling 45.

As pistons 122, 126 reciprocate within chambers 121, 125, well fluids 15 are sucked into sections 121*a*, 125*a* from well fluids conduit 116 and inlet passage 111, respectively, in an alternating fashion, and pumped from sections 125*a*, 121*a*, respectively, to outlet passage 112 and tubing 40 in an alternating fashion. In this manner, fluid end pump 110 pumps well fluids 15 through tubing 40 to the surface 11. Since fluid end pump 110 is a double acting reciprocating pump, well fluids 15 are pumped from fluid end pump 110 to the surface 11 when pistons 122, 126 move axially downward and when pistons 122, 126 move axially upward, and well fluids 15 are sucked from separator 400 into fluid end pump 110 when pistons 122, 126 move axially downward and when pistons 122, 126 move axially upward.

Figure 5:
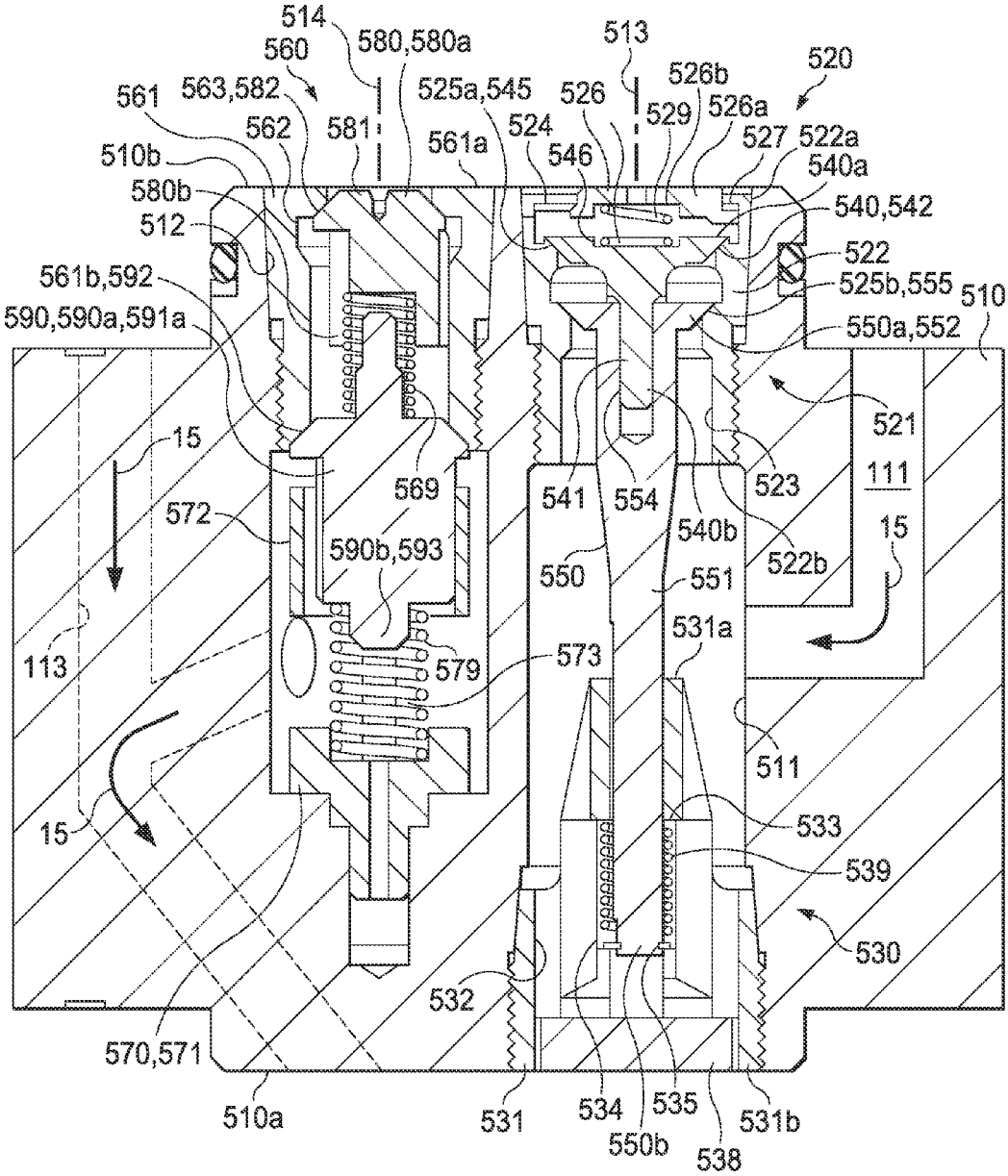
FIG. 5 is an enlarged cross-sectional view of the upper valve assembly of FIG. 4A.

Referring now to FIGS. 4A and 5, upper valve assembly 500 includes valve body 510, well fluids inlet valve 520 mounted within valve body 510, and well fluids outlet valve 560 mounted in valve body 510. Valve body 510 has a first or upper end 510*a* coupled to coupling 45 and a second or lower end 510*b* coupled to housing upper end 110*a*. In addition, valve body 510 includes a throughbore 511 extending axially between ends 510*a, b*, and a counterbore 512 extending axially from end 510*b* and circumferentially spaced from bore 511. Bores 511, 512 have central axes 513, 514, respectively. Valves 520, 560 are removably disposed in counterbores 511, 512, respectively.

In this embodiment, both inlet valve 520 and outlet valve 560 are double poppet valves. Inlet valve 520 includes a seating assembly 521 disposed in bore 511 at end 510*b*, a retention assembly 530 disposed in bore 511 at end 510*b*, a primary poppet valve member 540, and a backup or secondary poppet valve member 550 telescopically coupled to primary poppet valve member 540. Retention assembly 521, seating assembly 530, and valve members 540, 550 are coaxially aligned with bore axis 513.

Seating assembly 521 includes a seating member 522 threaded into bore 511 at end 510*b*, an end cap 526, and a biasing member 529. Seating member 522 has a first end 522*a* proximal body end 510*b*, a second end 522*b* disposed in bore 511 opposite end 522*a*, and a central through passage 523 extending axially between ends 522*a, b*. In addition, the radially inner surface of seating member 522 includes an annular recess 524 proximal end 522*a*, a first annular shoulder 525*a* axially spaced from recess 524, and a second annular shoulder 525*b* axially spaced from shoulder 525*a*. First annular shoulder 525*a* is axially disposed between recess 524 and shoulder 525*b*. As will be described in more detail below, valve members 540, 550 move into and out of engagement with shoulders 525*a, b*, respectively, to transition between closed and opened positions. Thus, annular shoulders 525*a, b* may also be referred as valve seats 525*a, b*, respectively.

Figure 7:
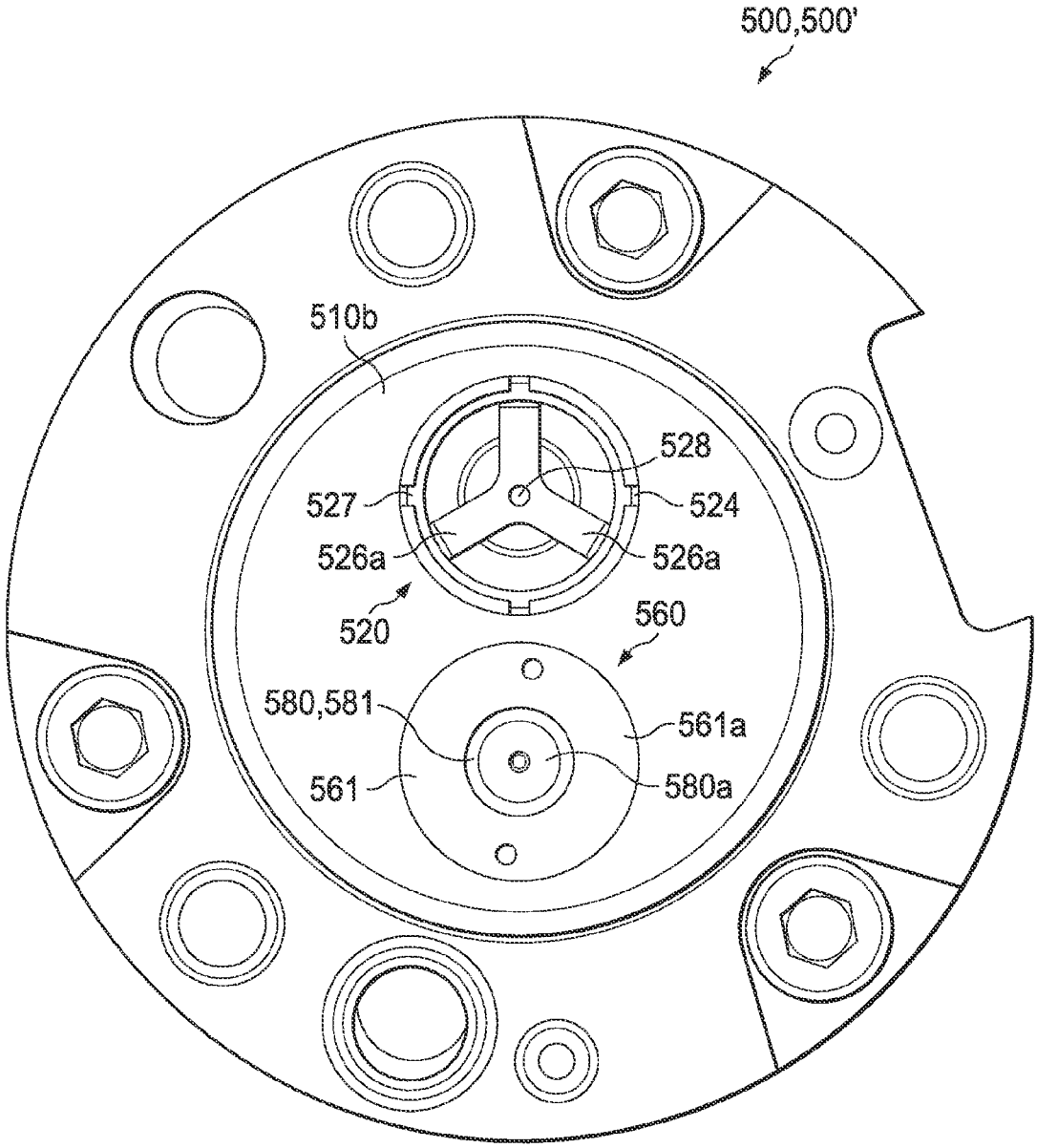
FIG. 7 is an enlarged end view of the upper valve assembly of FIG. 5.

End cap 526 is disposed in passage 523 at end 522*a* and is maintained within passage 523 with a snap ring 527 that extends radially into retention member recess 524. As best shown in FIG. 7, in this embodiment, end cap 526 includes a plurality of radially extending arms 526*a* and a central throughbore 528. The voids or spaces circumferentially disposed between adjacent arms 526*a*, as well as central throughbore 528, allow well fluids 15 to flow axially across end cap 526.

Referring again to FIGS. 4A and 5, biasing member 529 is axially compressed between end cap 526 and primary valve member 540. Thus, biasing member 529 biases primary valve member 540 axially away from end cap 526 and into engagement with valve seat 525*a*. In other words, biasing member 529 biases primary valve member 540 to a "closed" position. Specifically, when primary valve member 540 is seated in valve seat 525*a*, axial fluid flow through inlet valve 520 between inlet passage 111 and section 121*a* is restricted and/or prevented. In this embodiment, biasing member 529 is seated in a cylindrical recess 526*b* in end cap 526, which restricts and/or prevents biasing member 529 from moving radially relative to end cap 526. Although biasing member 529 is a coil spring in this embodiment, in general, biasing member (e.g., biasing member 529) may comprise any suitable device for biasing the primary valve member (e.g., valve member 540) to the closed position.

Referring still to FIGS. 4A and 5, retention assembly 530 includes a retention member 531 threaded into bore 511 at end 510*a*, an end cap 538, and a biasing member 539. Retention member 531 has a first end 531*a* disposed in bore 511 and a second end 531*b* flush with end 510*a*. In addition, retention member 531 includes a central through passage 532 extending axially between ends 531*a, b*, and an annular shoulder 533 axially positioned between ends 531, b in passage 532. End cap 538 is threaded into passage 532 at end 531*b* and closes off passage 532 and bore 511 at end 531*b*.

Secondary valve member 550 extends axially into passage 532. In particular, secondary valve member 550 slidingly engages retention member 531 between end 531*a* and shoulder 533, but is radially spaced from retention member 531 between shoulder 533 and end 531*b*. A retention ring 534 disposed about secondary valve member 550 is axially positioned between shoulder 533 and end 531*b*. A snap ring 535 disposed about secondary valve member 550 prevents retention ring 534 from sliding axially off of secondary valve member 550. Thus, biasing member 539 biases secondary valve member 550 axially towards end 510*b* and into engagement with valve seat 525*b*. In other words, biasing member 539 biases secondary valve member 550 to a "closed" position. Specifically, when secondary valve member 550 is seated in valve seat 525*b*, axial fluid flow through inlet valve 520 between inlet passage 111 and section 121*a* is restricted and/or prevented. Although biasing member 539 is a coil spring in this embodiment, in general, biasing member (e.g., biasing member 539) may comprise any suitable device for biasing the primary valve member (e.g., valve member 550) to the closed position.

Referring still to FIGS. 4A and 5, valve members 540, 550 have first ends 540*a*, 550*a*, respectively, and second ends 540*b*, 550*b*, respectively. In addition, each valve member 540, 550 includes a elongate valve stem 541, 551, respectively, extending axially from end 540*b*, 550*b*, respectively, and a valve head 542, 552, respectively, that extends radially outward from valve stem 541, 551, respectively, at end 540*a*, 550*b*, respectively. Further, each valve head 542, 552 includes a sealing surface 545, 555, respectively, that mates with and sealingly engages valve seat 525*a, b*, respectively, when valve head 542, 552, respectively, is seated therein. In this embodiment, sealing surfaces 545, 555, and mating surfaces of valve seats 525*a*, 525*b*, respectively, are frustoconical.

Stem 551 of secondary valve member 550 extends axially into passage 532 and includes an annular recess in which snap ring 535 is seated. Secondary valve member 550 also includes a central counterbore 554 extending axially from end 550*a* through head 552 and into stem 551. Stem 541 of primary valve member 540 is slidingly received by counterbore 554. Further, head 542 of primary valve member 540 includes a cylindrical recess 546. Biasing member 529 is seated in recess 546, which restricts and/or prevents biasing member 529 from moving radially relative to valve head 542.

As previously described, during pumping operations, inlet valve 520 of upper valve assembly 500 controls the supply of well fluids 15 to section 121*a*. In particular, valve members 540, 550 are biased to closed positions engaging seats 525*a, b*, respectively, and valve heads 542, 552, are axially positioned between seats 525*a, b*, respectively, and section 121*a*. Thus, when the pressure in chamber 121*a* is equal to or greater than the pressure in passage 111, valves heads 542, 552 sealingly engage valve seats 525*a, b*, respectively, thereby restricting and/or preventing fluid flow between passage 111 and section 121*a*. However, as piston 122 begins to move axially downward within chamber 121, the volume of section 121*a* increases and the pressure therein decreases. As the pressure in section 121*a* drops below the pressure in passage 111, the pressure differential seeks to urge valves members 540, 550 axially downward and out of engagement with seats 525*a, b*, respectively. Biasing members 529, 539 bias valve members 540, 550, respectively, in the opposite axial direction and seek to maintain sealing engagement between biasing members valve heads 542, 552 and valve seats 525*a, b*, respectively. However, once the pressure in section 121*a* is sufficiently low (i.e., low enough that the pressure differential between section 121*a* and passage 111 is sufficient to overcome biasing member 529), valve member 540 unseats from seat 525*a* and compresses biasing member 529. Then, almost instantaneously, the combination of the relatively low pressure in section 121*a* and relatively high pressure of well fluids in passage 111 overcomes biasing member 539, valve member 550 unseats from seat 525*b* and compresses biasing member 539, thereby transitioning inlet valve 520 to an "opened" position allowing fluid communication between passage 111 and section 121*a*. Since the pressure in section 121*a* is less than the pressure of well fluids 15 in passage 111, well fluids 15 will flow through inlet valve 520 into section 121*a* from passage 111. In this embodiment, biasing members 529, 539 provide different biasing forces. In particular, biasing member 529 provides a lower biasing force than biasing member 539 (e.g., biasing member 529 is a lighter duty coil spring than biasing member 539).

After piston 122 reaches its axially innermost stroke end proximal shuttle valve assembly 130 and begins to move axially upward within chamber 121, the volume of chamber 121*a* decreases and the pressure therein increases. Once the pressure in section 121*a* in conjunction with the biasing forces provided by biasing members 529, 539 are sufficient to overcome the pressure in passage 111, valve members 540, 550 move axially upward and seat against valve seats 525*a, b*, respectively, thereby transitioning back to the closed positions restricting and/or preventing fluid communication between section 121*a* and passage 111.

Referring again to FIGS. 4A and 5, outlet valve 560 includes a seating member 561 disposed in counterbore 512 at end 510*b*, a guide member 570 disposed in counterbore 512 distal end 510*b*, a primary poppet valve member 580, and a backup or secondary poppet valve member 590 telescopically coupled to primary poppet valve member 580. Retention member 561, guide member 570, and valve members 580, 590 are coaxially aligned with counterbore axis 514.

Seating member 561 is threaded into counterbore 512 at end 510*b* and has a first end 561*a* flush with body end 510*b*, a second end 561*b* disposed in counterbore 512 opposite end 561*a*, and a central through passage 562 extending axially between ends 561*a, b*. In addition, the radially inner surface of seating member 561 includes an annular shoulder 563 proximal end 561*a*. As will be described in more detail below, valve members 580, 590 move into and out of engagement with shoulder 563 and end 561*b*, respectively, to transition between closed and opened positions. Thus, annular shoulder 563 and seat member end 561*b* may also be referred as valve seats 563, 561*b*, respectively.

Valve member 580 is disposed in passage 562 and has a first end 580*a* and a second end 580*b* opposite end 580*a*. End 580*a* comprises a radially enlarged valve head 581 that mates with and sealingly engages valve seat 563. In this embodiment, valve head 581 includes a frustoconical sealing surface 582 that sealingly engages a mating frustoconical surface of valve seat 563. A biasing member 569 is axially compressed between valve members 580, 590. Thus, biasing member 569 biases primary valve member 580 axially away from valve member 590 and into engagement with valve seat 563. In other words, biasing member 569 biases primary valve member 580 to a "closed" position. Specifically, when primary valve member 580 is seated in valve seat 563, fluid communication between outlet passage 113 and section 121*a* is restricted and/or prevented. In this embodiment, biasing member 569 is seated in a cylindrical counterbore 583 extending axially from end 580*b*, thereby restricting and/or preventing biasing member 569 from moving radially relative to valve member 580. Although biasing member 569 is a coil spring in this embodiment, in general, biasing member (e.g., biasing member 569) may comprise any suitable device for biasing the primary valve member (e.g., valve member 580) to the closed position.

Referring still to FIGS. 4A and 5, guide member 570 is disposed in counterbore 512 and includes a base section 571 seated in a recess 512*a* extending axially from counterbore 512, a valve guide section 572 disposed about valve member 590, and a plurality of circumferentially spaced arms 573 extending axially between sections 571, 572. A biasing member 579 is axially compressed between valve member 590 and base section 571. Thus, biasing member 579 biases secondary valve member 590 axially away from base section 571 and into engagement with valve seat 561*b*. In other words, biasing member 579 biases primary valve member 590 to a "closed" position. Specifically, when primary valve member 590 is seated in valve seat 561*b*, fluid communication between outlet passage 113 and section 121*a* is restricted and/or prevented. In this embodiment, biasing member 579 is seated in a cylindrical counterbore 574 in base section 571 and is radially disposed inside arms 573, thereby restricting and/or preventing biasing member 579 from moving radially relative to guide member 570. Although biasing member 579 is a coil spring in this embodiment, in general, biasing member (e.g., biasing member 579) may comprise any suitable device for biasing the primary valve member (e.g., valve member 590) to the closed position.

Valve member 590 is disposed in passage 562 and has a first end 590*a* and a second end 590*b* opposite end 590*a*. End 590*a* comprises a radially enlarged valve head 591 that mates with and sealingly engages valve seat 561*b*. In this embodiment, valve head 591 includes a frustoconical sealing surface 592 that sealingly engages a mating frustoconical surface of valve seat 561*b*. As previously described, biasing member 579 biases valve member 590 into sealing engagement with seat 561*b*. In addition, in this embodiment, end 590*b* comprises a cylindrical tip 593 that extends axially into biasing member 579, thereby restricting and/or preventing biasing member 579 and valve member 590 from moving radially relative to each other.

As previously described, during pumping operations, outlet valve 560 of upper valve assembly 500 controls the flow of well fluids 15 from section 121*a* into tubing 40. In particular, valve members 580, 590 are biased to closed positions engaging seats 563, 561*b*, respectively, and valve seats 563, 561*b* are axially positioned between valve heads 581, 591, respectively, and section 121*a*. Thus, when the pressure in chamber 121*a* is less than to or greater than the pressure in passage 113 and coupling 45, valves heads 581, 591 sealingly engage valve seats 563, 561*b*, respectively, thereby restricting and/or preventing fluid flow between coupling 45 and section 121*a*. However, as piston 122 begins to move axially upward within chamber 121, the volume of section 121*a* decreases and the pressure therein increases. As the pressure in section 121*a* increases above the pressure in passage 112 and coupling 45, the pressure differential seeks to urge valves members 580, 590 axially upward and out of engagement with seats 563, 561*b*, respectively. Biasing members 569, 579 bias valve members 580, 590, respectively, in the opposite axial direction and seek to maintain sealing engagement between biasing members valve heads 581, 591 and valve seats 563, 561*b*, respectively. However, once the pressure in section 121*a* is sufficiently high (i.e., high enough that the pressure differential between section 121*a* and passage 112 is sufficient to overcome biasing members 569), valve member 580 will unseat from seat 563 and compresses biasing member 569. Then, almost instantaneously, the combination of the relatively high pressure in section 121*a* and relatively lower pressure in passage 112 overcome biasing member 579, valve member 590 unseats from seat 561*b*, thereby transitioning outlet valve 560 to an "opened" position allowing fluid communication between passage 112 and section 121*a*. Since the pressure in section 121*a* is greater than the pressure of well fluids 15 in passage 112, well fluids 15 will flow through outlet valve 560 from section 121*a* into passage 112, coupling 45, and tubing 40. In this embodiment, biasing members 569, 579 provide different biasing forces. In particular, biasing member 569 provides a lower biasing force than biasing member 579 (e.g., biasing member 569 is a lighter duty coil spring than biasing member 579).

After piston 122 reaches its axially outermost stroke end distal shuttle valve assembly 130 and begins to move axially downward within chamber 121, the volume of chamber 121*a* increases and the pressure therein decreases. Once the pressure in coupling 45 in conjunction with the biasing forces provided by biasing members 569, 579 are sufficient to overcome the pressure in section 121*a*, valve members 580, 590 move axially downward and seat against valve seats 563, 561*b*, respectively, thereby transitioning back to the closed positions restricting and/or preventing fluid communication between section 121*a* and coupling 45.

Figure 6:
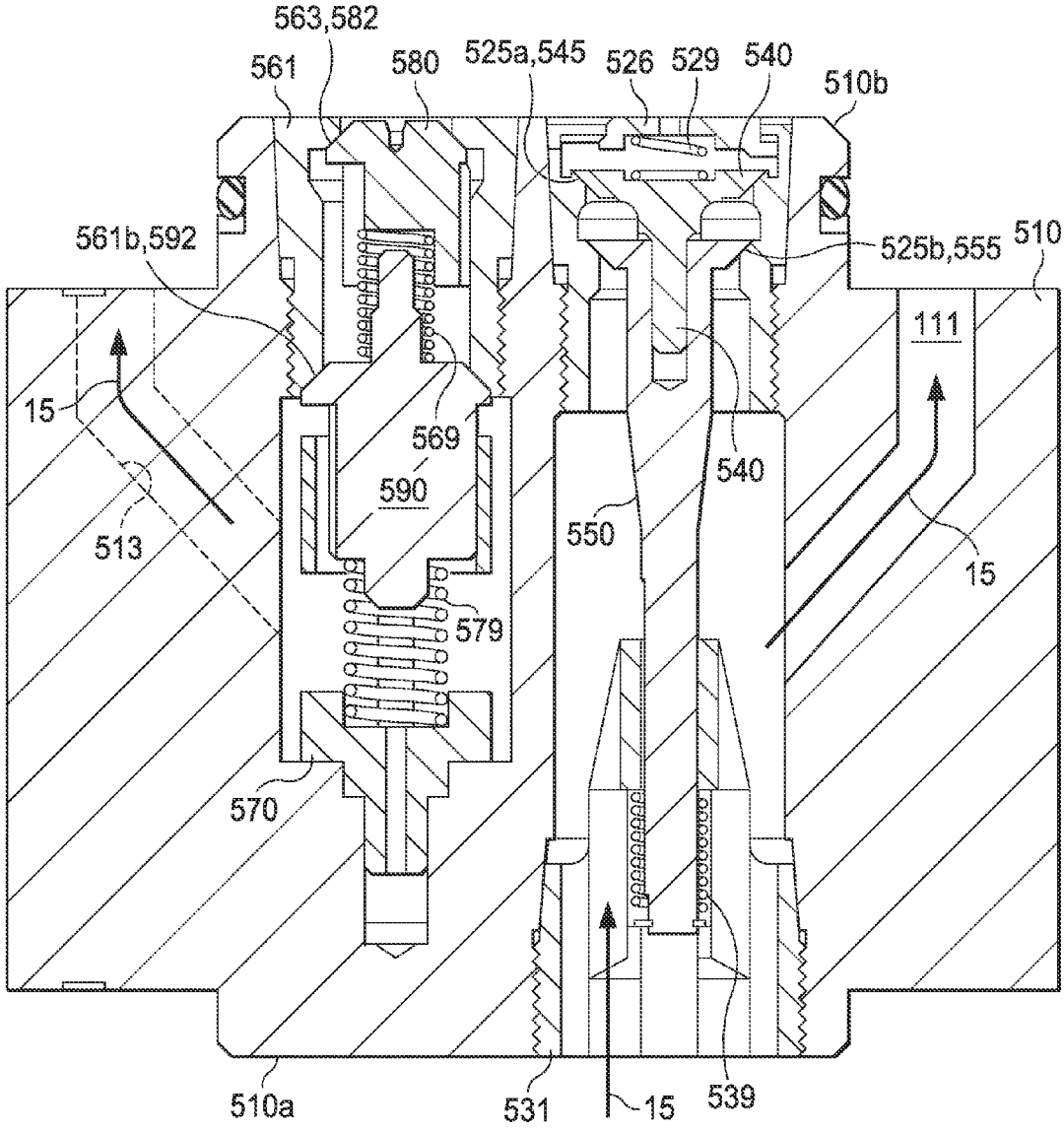
FIG. 6 is an enlarged cross-sectional view of the lower valve assembly of FIG. 4B.

Referring now to FIGS. 4B and 6, lower valve assembly 500' is configured and operates substantially the same as upper valve assembly 500 previously described. Namely, lower valve assembly 500' includes valve body 510, well fluids inlet valve 520 mounted within valve body 510, and well fluids outlet valve 560 mounted in valve body 510, each as previously described. However, lower valve assembly 500' is axially disposed between lower end 110*b* of fluid end pump housing 110 and hydraulic pump 200, inlet valve 520 of lower valve assembly 500' controls the supply of well fluids 15 to section 125*a*, and outlet valve 560 of lower valve assembly 500' controls the flow of well fluids 15 from section 125*a* into tubing 40 via passage 113 and coupling 45. Further, seating assembly 521 of lower valve assembly 500' does not include does not include end cap 526. Thus, inlet valve 520 of lower valve assembly 500' is in fluid communication with well fluids conduit 116. Although FIG. 7 illustrates an end view of end 510*b* of upper valve assembly 500, it is also representative of an end view of end 510*b* of lower valve assembly 500'. In other words, end view of ends 510*b* of both valve assemblies 500, 500' are the same.

As previously described, during pumping operations, inlet valve 520 of lower valve assembly 500' controls the supply of well fluids 15 to section 125*a*. In particular, valve members 540, 550 are biased to closed positions engaging seats 525*a, b*, respectively, and valve heads 542, 552, are axially positioned between seats 525*a, b*, respectively, and section 121*a*. Thus, when the pressure in chamber 125*a* is equal to or greater than the pressure in well fluids conduit 116, valves heads 542, 552 sealingly engage valve seats 525*a, b*, respectively, thereby restricting and/or preventing fluid flow between well fluids conduit 116 and section 125*a*. However, as piston 126 begins to move axially upward within chamber 125, the volume of section 125*a* increases and the pressure therein decreases. As the pressure in section 125*a* drops below the pressure in well fluids conduit 116, the pressure differential seeks to urge valves members 540, 550 axially downward and out of engagement with seats 525*a, b*, respectively. Biasing members 529, 539 bias valve members 540, 550, respectively, in the opposite axial direction and seek to maintain sealing engagement between biasing members valve heads 542, 552 and valve seats 525*a, b*, respectively. However, once the pressure in section 125*a* is sufficiently low (i.e., low enough that the pressure differential between section 1251*a* and well fluids conduit 116 is sufficient to overcome biasing members 529, 539), valve members 540, 550 will unseat from seats 525*a, b*, respectively, thereby transitioning inlet valve 520 of lower valve assembly 500' to an "opened" position allowing fluid communication between well fluids conduit 116 and section 125*a*. Since the pressure in section 125*a* is less than the pressure of well fluids 15 in well fluids conduit 116, well fluids 15 will flow through inlet valve 520 into section 125*a* from well fluids conduit 116. In this embodiment, biasing members 529, 539 provide different biasing forces. In particular, biasing member 529 provides a lower biasing force than biasing member 539 (e.g., biasing member 529 is a lighter duty coil spring than biasing member 539). Thus, valve member 540 of lower valve assembly 500' will unseat just before valve member 550 of lower valve assembly 500'.

After piston 126 reaches its axially innermost stroke end proximal shuttle valve assembly 130 and begins to move axially downward within chamber 125, the volume of chamber 125*a* decreases and the pressure therein increases. Once the pressure in section 125*a* in conjunction with the biasing forces provided by biasing members 529, 539 are sufficient to overcome the pressure in well fluids conduit 116, valve members 540, 550 move axially upward and seat against valve seats 525*a, b*, respectively, thereby transitioning back to the closed positions restricting and/or preventing fluid communication between section 125*a* and well fluids conduit 116.

Referring still to FIGS. 4B and 6, as previously described, during pumping operations, outlet valve 560 of lower valve assembly 500' controls the flow of well fluids 15 from section 125*a* into tubing 40 via passage 113 and coupling 45. In particular, valve members 580, 590 are biased to closed positions engaging seats 563, 561*b*, respectively, and valve seats 563, 561*b* are axially positioned between valve heads 581, 591, respectively, and section 125*a*. Thus, when the pressure in chamber 125*a* is less than to or greater than the pressure in passage 113 and coupling 45, valves heads 581, 591 sealingly engage valve seats 563, 561*b*, respectively, thereby restricting and/or preventing fluid flow between coupling 45 and section 125*a*. However, as piston 126 begins to move axially downward within chamber 125, the volume of section 125*a* decreases and the pressure therein increases. As the pressure in section 125*a* increases above the pressure in passage 113, the pressure differential seeks to urge valves members 580, 590 axially upward and out of engagement with seats 563, 561*b*, respectively. Biasing members 569, 579 bias valve members 580, 590, respectively, in the opposite axial direction and seek to maintain sealing engagement between biasing members valve heads 581, 591 and valve seats 563, 561*b*, respectively. However, once the pressure in section 125*a* is sufficiently high (i.e., high enough that the pressure differential between section 125*a* and passage 113 is sufficient to overcome biasing members 569, 579), valve members 580, 590 will unseat from seats 563, 561*b*, respectively, thereby transitioning outlet valve 560 of lower valve assembly 500' to an "opened" position allowing fluid communication between section 125*a* and passage 112. Since the pressure in section 125*a* is greater than the pressure of well fluids 15 in passage 113, well fluids 15 will flow through outlet valve 560 from section 125*a* into passage 113, coupling 45, and tubing 40. In this embodiment, biasing members 569, 579 provide different biasing forces. In particular, biasing member 569 provides a lower biasing force than biasing member 579 (e.g., biasing member 569 is a lighter duty coil spring than biasing member 579). Thus, valve member 580 of lower valve assembly 500' will unseat just before valve member 590 of lower valve assembly 500'.

After piston 126 reaches its axially outermost stroke end distal shuttle valve assembly 130 and begins to move axially upward within chamber 125, the volume of chamber 125*a* increases and the pressure therein decreases. Once the pressure in passage 113 in conjunction with the biasing forces provided by biasing members 569, 579 are sufficient to overcome the pressure in section 125*a*, valve members 580, 590 move axially downward and seat against valve seats 563, 561*b*, respectively, thereby transitioning back to the closed positions restricting and/or preventing fluid communication between section 125*a* and passage 113.

In the manner described, inlet valve 520 and outlet valve 560 of upper valve assembly 500 control the flow of well fluids 15 into and out of section 121*a*, and inlet valve 520 and outlet valve 560 of lower valve assembly 500' control the flow of well fluids 15 into and out of section 125*a*. Each valve 520, 560 includes two poppet valve members adapted to move into and out of engagement with mating valve seats. Namely, inlet valve 520 includes poppet valve members 540, 550, and outlet valve 560 includes poppet valve members 580, 590. Valve members 540, 550 are capable of operating independent of one another. Thus, valve member 540 may seat against valve seat 525*a* even if valve member 550 is not seated against valve seat 525*b*, and vice versa. Likewise, valve members 580, 590 are capable of operating independent of one another. Thus, valve member 580 may seat against valve seat 563 even if valve member 590 is not seated against valve seat 561*b*, and vice versa. Inclusion of multiple, serial, operationally independent valve members 540, 550 in inlet valve 520 offers the potential to enhance the reliability and sealing of inlet valve 520 in harsh downhole conditions. For example, even if valve member 540 gets stuck in the opened position (e.g., solids get jammed between valve member 540 and seat 525*a*), valve member 550 can still sealingly engage valve seat 525*b*, thereby closing inlet valve 520. Likewise, inclusion of multiple, serial, operationally independent valve members 580, 590 in outlet valve 560 offers the potential to enhance the reliability and sealing of inlet valve 560 in harsh downhole conditions. For example, even if valve member 590 gets stuck in the opened position (e.g., solids get jammed between valve member 590 and seat 561*b*), valve member 580 can still sealingly engage valve seat 563, thereby closing outlet valve 560.

Referring now to FIGS. 3 and 4C, hydraulic pump 200 has a first or upper end 200*a* coupled to distributor 115 and a second or lower end 200*b* coupled to motor 300. In addition, hydraulic pump 200 includes a radially outer housing 210, a first or upper pump chamber 220 disposed in housing 210, a second or lower pump chamber 230 disposed in housing 210 and axially spaced below chamber 220, a bearing chamber 240 axially disposed between chambers 220, 230, an upper pump assembly 250 disposed in chamber 220, a lower pump assembly 280 disposed in chamber 230, and a bearing assembly 245 disposed in bearing chamber 240. As will be described in more detail below, hydraulic fluid fills chambers 220, 230, 240 and baths the components disposed in chambers 220, 230, 240.

A tubular well fluids conduit 205 extends coaxially through hydraulic pump 200 and is in fluid communication with conduit 116 of distributor 115. As will be described in more detail below, conduit 205 supplies well fluids 15 from separator 400 to fluid end pump 110 via distributor conduit 116. Although conduit 205 extends through hydraulic pump 200, it is not in fluid communication with any of chambers 220, 230, 240.

Referring now to FIG. 4C, housing 210 includes a tubular section 211, an upper end cap 212 coupled to section 211 and defining upper end 210*a*, and a lower end cap 213 coupled to the opposite end of section 211 and defining lower end 210*b*. The radially inner surface of tubular section 211 includes an upwardly facing annular shoulder 211*a*, and a downwardly facing annular shoulder 211*b* axially spaced from shoulder 211*a*. Upper chamber 220 is axially disposed between shoulder 211*a* and upper end cap 212, lower chamber 230 is axially disposed between shoulder 211*b* and lower end cap 213, and bearing chamber 240 is axially disposed between shoulders 211*a,b*. A hydraulic fluid supply passage 214 extends axially through tubular section 211 and is in fluid communication with a plurality of hydraulic fluid supply passages or branches 215, 216 extending through end caps 212, 213, respectively. Due to the orientation of the cross-section of pump 200 shown in FIG. 4C, only one branch 215 is shown in end cap 212, and only one branch 216 is shown in end cap 213. However, in actuality, there are multiple branches 215 in end cap 212 and in fluid communication with passage 214, and multiple branches 216 in end cap 213 and in fluid communication with passage 214. Each branch 215, 216 includes a check valve 217 that allows one-way fluid flow from its corresponding branch 215, 216 into passage 214.

Passage 214 is in fluid communication with hydraulic fluid passage 113 of fluid end pump 110 via hydraulic fluid conduit 117 extending through distributor 115. Thus, hydraulic pump 200 supplies compressed hydraulic fluid to shuttle valve assembly 130 previously described via branches 215, 216 and passages 214, 117, 113. A hydraulic fluid return passage (not shown) allows hydraulic fluid from shuttle valve assembly 130 to return to chambers 220, 230, 240 of hydraulic pump 200. End caps 212, 213 include throughbores 218, 219, respectively, through which conduit 205 extends.

Referring still to FIG. 4C, upper pump assembly 250 is disposed in chamber 220 and includes a guide member 251, a plurality of elongate, circumferentially spaced pistons 255 (only one visible in FIG. 4C), a biasing member 260, a biasing sleeve 261, a top hat or swivel plate 265, and a wobble plate 270. Guide member 251, swivel plate 265, biasing member 270, biasing sleeve 271, and wobble plate 280 are each disposed about conduit 205. In this embodiment, upper pump assembly 250 includes three uniformly circumferentially spaced pistons 255.

Guide member 251 axially abuts end cap 212 and includes a central throughbore 252, a plurality of circumferentially spaced piston guide bores 253 radially spaced from central throughbore 252, and an axially extending counterbore 254 coaxially aligned with throughbore 252 and facing the remainder of assembly 250. Biasing member 260 is seated in counterbore 254, and biasing sleeve 261 is disposed about biasing member 260 and slidingly engages counterbore 254. As will be described in more detail below, biasing member 260 is compressed between guide member 251 and biasing sleeve 261, and thus, biases biasing sleeve 261 axially away from guide member 251. Each guide bore 253 is aligned with and in fluid communication with one of the branches 215 in end cap 212. In addition, one piston 255 is telescopically received by and extends axially from each of the piston guide bores 253.

Biasing sleeve 261 has a first or upper end 261*a* disposed in counterbore 254, a second end 261*b* opposite end 261*a*, and a radially inner surface including an annular shoulder 262 between ends 261*a, b* and a frustoconical seat 263 at end 261*b*. Biasing member 260 axially abuts annular shoulder 262 and guide member 251, and swivel plate 265 is pivotally seated in seat 263.

Each piston 255 is disposed at the same radial distance from axis 105 and has a first end 255*a* disposed in one bore 253, a second end 255*b* axially positioned between swivel plate 265 and wobble plate 270, and a throughbore 256 extending axially between ends 255*a, b*. Throughbore 256 of each piston 255 is in fluid communication with its corresponding bore 253. In this embodiment, end 255*b* of each piston 255 comprises a spherical head 257.

Referring still to FIG. 4C, swivel plate 265 includes a base 266 at least partially seated in seat 263 and a flange 267 extending radially outward from base 266 outside of seat 263. Base 266 has a generally curved, convex radially outer surface 266*a* that slidingly engages seat 263, thereby allowing swivel plate 265 to pivot relative to biasing sleeve 261. Flange 267 includes a planar end face 268 opposing wobble plate 270 and a plurality of circumferentially spaced bores 269. One piston 255 extends axially through each bore 269. A piston retention ring 290 is disposed about each piston head 257, and is axially positioned between flange 267 and piston head 257. Each retention ring 290 has a planar surface 291 engaging planer end face 268 and a spherical concave seat 292 opposite surface 291. Spherical piston head 257 is pivotally seated in mating seat 292. Each retention ring 290 maintains sealing engagement with both flange 267 and its corresponding piston head 257 as swivel plate 265 pivot relative to biasing sleeve 261.

It should be appreciated that swivel plate 265 is disposed about conduit 205 but radially spaced from conduit 205 by a radial distance that provides sufficient clearance therebetween as swivel plate 265 pivots relative to biasing sleeve 261. Likewise, each bore 269 in swivel plate 265 has a diameter greater than the outside diameter of the portion of piston 255 extending therethrough to provide sufficient clearance therebetween as swivel plate 265 pivots relative to that piston 255.

Figure 8:
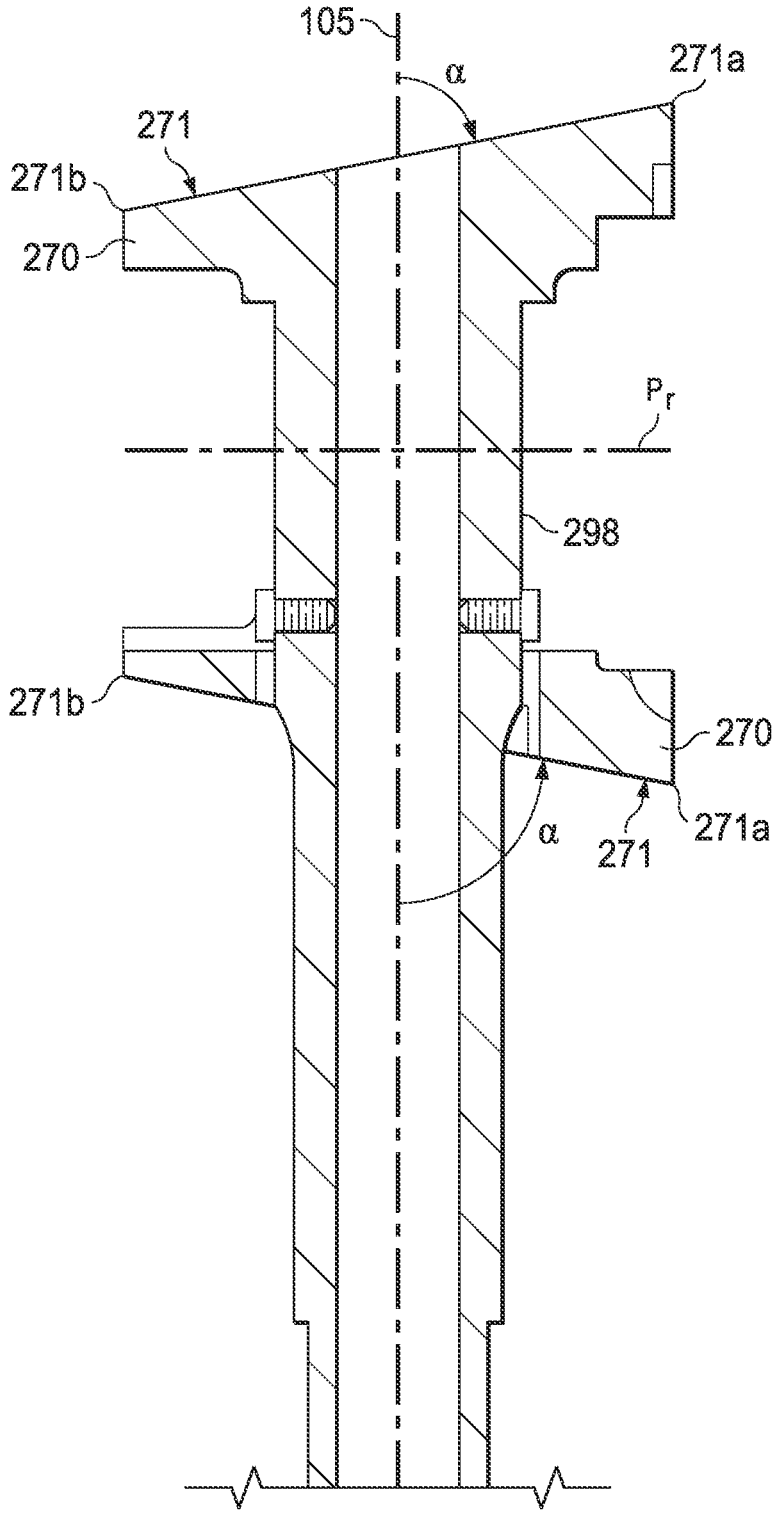
FIG. 8 is an enlarged cross-sectional view of the wobble plates of the hydraulic pump of FIG. 4C.
Figure 9:
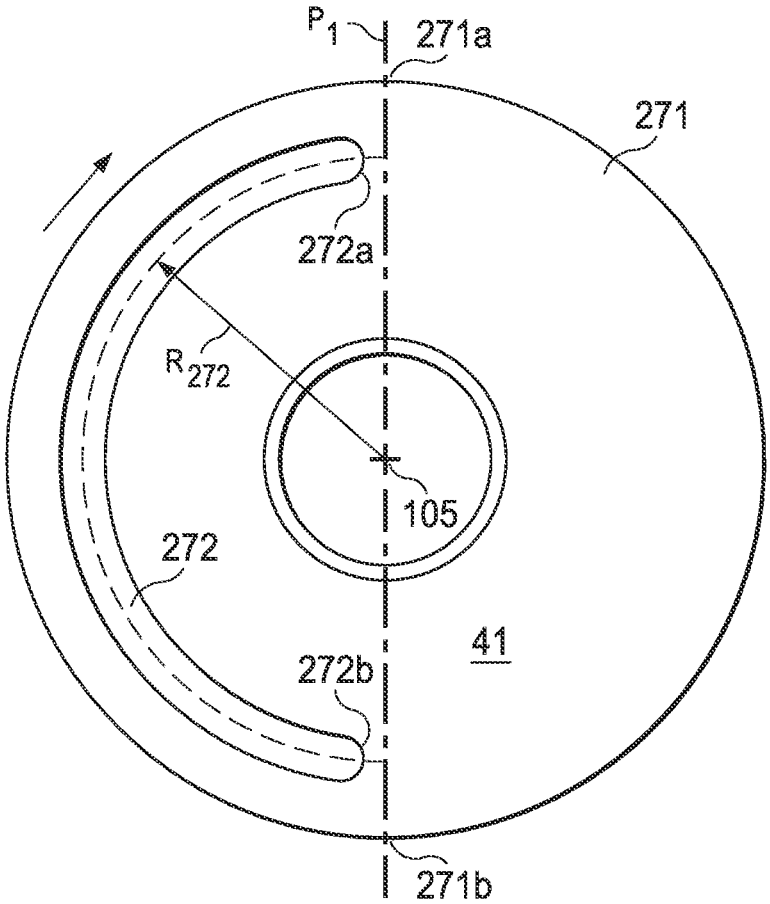
FIG. 9 is a top view of the wobble plate of the upper pump assembly of FIG. 4C.
Figure 10:
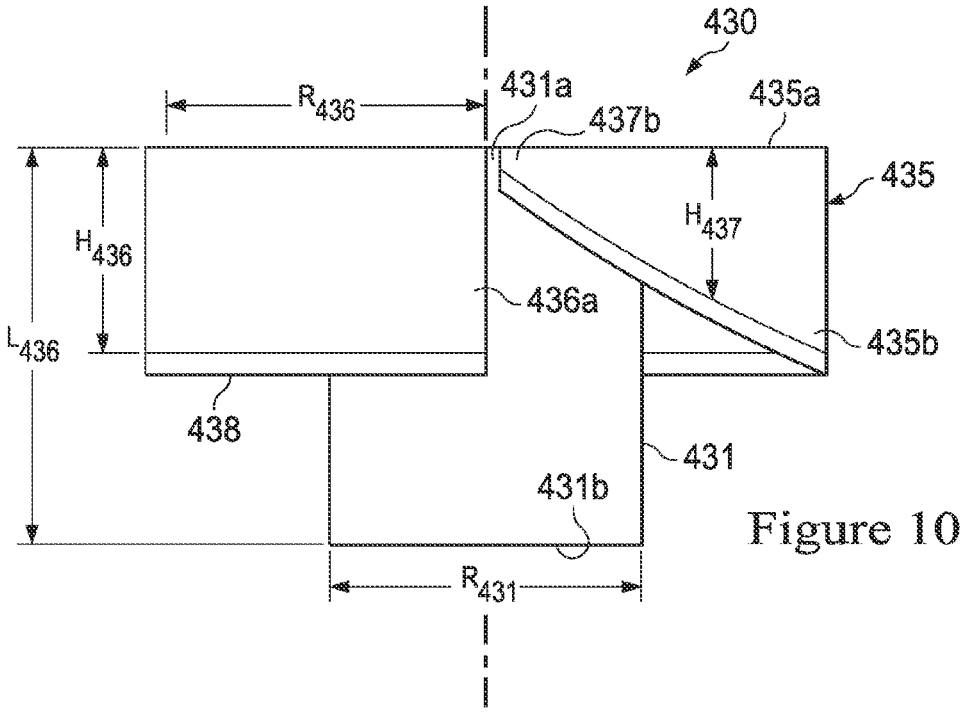
FIG. 10 is a side view of the cyclone intake of FIG. 4G.

Referring now to FIGS. 4C, 8, and 9, wobble plate 270 comprises a planar end face 271 opposed flange end face 269 and an arcuate slot 272 extending axially through plate 270. End face 271 is oriented at an acute angle $\alpha$ relative to axis 105. Angle $\alpha$ is preferably between 0° and 60°, and more preferably between 10° and 45°. Due to its angular orientation relative to axis 105, end face 271 slopes from an axially outermost point 271*a* relative to a reference plane $P_r$ perpendicular to axis 105 and axially positioned between pump assemblies 250, 280, and an axially innermost point 271*b* relative to a reference plane $P_r$. Points 271*a, b* are 180° apart relative to axis 105. Since end face 271 of wobble plate 270 of upper pump assembly 250 faces upwards, point 271*a* represents the axially uppermost point on end face 271 and point 271*b* represents the axially lowermost point on end face 271. As will be described in more detail below, end face 271 of wobble plate 270 of lower pump assembly 280 faces downwards, and thus, corresponding point 271 represents the axially lowermost point on end face 271 of wobble plate 270 of lower pump assembly 280 and corresponding point 271*b* represents the axially uppermost point on end face 271 of wobble plate 270 of lower pump assembly 280.

As best shown in FIG. 9, slot 272 is disposed at a uniform radial distance $R_{272}$ relative to axis 105, and has a first end 272*a* and a second end 272*b* angularly spaced slightly less than 180° from first end 272*a* about axis 105. In this embodiment, ends 272*a, b* are generally radially aligned with points 271*a, b*, respectively. In other words, each end 272*a, b* is circumferentially adjacent or proximal a reference plane $P_1$ passing through points 271*a, b* and containing axis 105. Each spherical piston head 257 is disposed at the same radial distance $R_{272}$ from axis 105. Thus, piston heads 257 are circumferentially aligned with slot 272.

A piston interface shoe 295 is disposed about each piston head 257, and is axially positioned between wobble plate 270 and piston head 257. Each interface shoe 295 has a planar surface 296 slidingly engaging planer end face 271 and a spherical concave seat 297 opposite surface 296. Spherical piston head 257 is pivotally seated in mating seat 297.

Referring now to FIGS. 4C and 8, a tubular drive shaft 298 is coaxially disposed about conduit 205 and drives the rotation of wobble plate 270 about axis 105. In this embodiment, drive shaft 298 is integral with and monolithically formed with wobble plate 270 of upper pump assembly 250. However, in other embodiments, the drive shaft that drives the rotation of a wobble plate may be a distinct and separate component that is coupled to the wobble plate. The radially inner surface of driveshaft 298 may be polished smooth and/or have a mirror finish to reduce friction with conduit 205.

As wobble plate 270 rotates, the axial distance from each piston guide bore 253 to wobble plate end face 271 cyclically varies. For example, the axial distance from a given guide bore 253 and end face 271 is maximum when the "thin" portion of wobble plate 270 is axially opposed that guide bore 253, and the axial distance from a given guide bore 253 and end face 271 is minimum when the "thick" portion of wobble plate 270 is axially opposed that guide bore 253. However, pistons 255 move axially back and forth within bores 253 to maintain piston head 257 axially adjacent end face 271. Specifically, biasing member 260 biases biasing sleeve 261 axially into swivel plate 265, which in turn, biases retention rings 290 and corresponding piston heads 257 against end face 271. Sliding engagement of swivel plate surface 266*a* and bias sleeve seat 263 allows simultaneous axial biasing of swivel plate 265 and pivoting of swivel plate 265 relative to biasing sleeve 261. It should also be appreciated that engagement of each spherical piston head 257 with a corresponding spherical retention ring seat 292 and spherical interface shoe seat 297 enables ring 290 and shoe 295 to slidingly engage head 257 and pivot about head 257 while maintaining contact with head 257 and plates 265, 270, respectively.

As wobble plate 270 rotates, pistons 255 reciprocate axially within guide bores 253 and slot 272 cyclically moves into and out of fluid communication with bore 256 of each piston 255. In particular, wobble plate 270 is rotated such that bore 256 of each piston 255 first comes into fluid communication with slot 272 at end 272*a* (generally aligned with point 271*a*) and moves out of fluid communication with sot 272 at end 272*b* (generally aligned with point 271*b*). Thus, bore 256 of each piston 255 is in fluid communication with slot 272 as corresponding piston head 257 moves axially downward and away from guide member 251 as it is biased against end face 271. Accordingly, bore 256 of each piston 255 is in fluid communication with slot 272 as piston 255 telescopically extends axially from its corresponding bore 253. As previously described, check valve 217 in each branch 215 only allows one-way fluid communication from bore 253 to corresponding branch 215. Thus, as each piston 255 extends from its corresponding guide bore 253, the fluid pressure within associated bores 253, 256 decreases and hydraulic fluid within chamber 220 flows through slot 272 and fills bores 253, 256. As will be described in more detail below, compensator 350 maintains hydraulic fluid in chambers 220, 230, 240 at a fluid pressure sufficient to drive hydraulic fluid flow into pistons 255 when piston bores 256 are in fluid communication with chambers 220, 230, 240 via slot 272.

Conversely, once each piston 256 moves out of fluid communication with slot 272, corresponding piston head 257 moves axially upward and toward guide member 251. Accordingly, bore 256 of each piston 255 is isolated from (i.e., not in fluid communication with) slot 272 as piston 255 is telescopically pushed axially into its corresponding bore 253. As each piston 255 is axially pushed further into its corresponding guide bore 253, the hydraulic fluid in associated bores 253, 256 is compressed. As previously described, check valve 217 in each branch 215 only allows one-way fluid communication from bore 253 to corresponding branch 215. Thus, when the hydraulic fluid in bores 253, 256 is sufficiently compressed (i.e., the pressure differential across check valve 217 exceeds the cracking pressure of check valve 217), corresponding check valve 217 will open and allow the compressed hydraulic fluid in bores 253, 256 to flow into associated branch 215 and passage 214.

Referring again to FIGS. 4C and 8, lower pump assembly 280 is disposed in chamber 230 and is the same as upper pump assembly 250 previously described. Namely, lower pump assembly 280 includes a guide member 251, three elongate, circumferentially spaced pistons 255 (only one visible in FIG. 4C), a biasing member 260, a biasing sleeve 261, a swivel plate 265, and a wobble plate 270, each as previously described. However, the components of lower pump assembly 280 are inverted such that end faces 271 of wobble plates 270 face away from each other—end face 271 of upper wobble plate 270 faces end cap 212 and end face 271 of lower wobble plate 270 faces end cap 213. Consequently, axially outermost point 271*a* of end face 271 of lower wobble plate 270 is the axially lowermost point on end face 271 and axially innermost point 271*b* of end face 271 of lower wobble plate 270 is the axially uppermost point on end face 271. Further, unlike wobble plate 270 of upper pump assembly 250 which is integral with driveshaft 298, wobble plate 270 of lower pump assembly 280 is disposed about driveshaft 298 and keyed to driveshaft 298 such that wobble plate 270 of lower pump assembly 280 rotates along with driveshaft 298 and wobble plate 270 of upper pump assembly 250.

Lower pump assembly 280 functions in the same manner as upper pump assembly 280 to supply compressed hydraulic fluid to shuttle valve assembly 130. However, each guide bore 253 of guide member 251 of lower pump assembly 280 is in fluid communication with one branch 216 in lower end cap 213. Thus, lower pump assembly 280 provides compressed hydraulic fluid to shuttle valve assembly 130 via branches 216 and passages 214, 117, 113. In particular, driveshaft 298 drives the rotation of lower wobble plate 270. As lower wobble plate 270 rotates, pistons 255 of lower pump assembly 280 reciprocate axially within guide bores 253 and slot 272 in lower wobble plate 270 cyclically moves into and out of fluid communication with bore 256 of each piston 255. In particular, lower wobble plate 270 is rotated such that bore 256 of each piston 255 first comes into fluid communication with slot 272 at end 272*a* (generally aligned with point 271*a* of lower wobble plate 270) and moves out of fluid communication with sot 272 at end 272*b* (generally aligned with point 271*b* of lower wobble plate 270). Thus, bore 256 of each piston 255 is in fluid communication with slot 272 as corresponding piston head 257 moves axially upward and away from guide member 251 as it is biased against end face 271 of lower wobble plate 270. Accordingly, bore 256 of each piston 255 is in fluid communication with slot 272 of lower wobble plate as piston 255 telescopically extends axially from its corresponding bore 253. Check valve 217 in each branch 216 only allows one-way fluid communication from bore 253 to corresponding branch 216. Thus, as each piston 255 extends from its corresponding guide bore 253, the fluid pressure within associated bores 253, 256 decreases and hydraulic fluid within chamber 230 flows through slot 272 in lower wobble plate 270 and fills bores 253, 256. Conversely, once each piston 256 of lower pump assembly 280 moves out of fluid communication with slot 272 in lower wobble plate 270, corresponding piston head 257 moves axially downward and toward guide member 251. Accordingly, bore 256 of each piston 255 in lower pump assembly 280 is isolated from (i.e., not in fluid communication with) slot 272 of lower wobble plate as piston 255 is telescopically pushed axially into its corresponding bore 253. As each piston 255 of lower pump assembly 280 is axially pushed further into its corresponding guide bore 253, the hydraulic fluid in associated bores 253, 256 is compressed. As previously described, check valve 217 in each branch 216 only allows one-way fluid communication from bore 253 to corresponding branch 216. Thus, when the hydraulic fluid in bores 253, 256 is sufficiently compressed (i.e., the pressure differential across check valve 217 exceeds the cracking pressure of check valve 217), corresponding check valve 217 will open and allow the compressed hydraulic fluid in bores 253, 256 to flow into associated branch 216 and passage 214.

In the manner described, each piston 255 of upper pump assembly 250 and lower pump assembly 280 axially reciprocates within its corresponding guide bore 253, piston bores 256 move into and out of fluid communication with slots 272, and compressed hydraulic fluid is supplied to shuttle valve assembly 130 via branches 215, 216 and passages 214, 117, 113. Although only one piston 255 is shown in each pump assembly 250, 280, however, as previously described, in this embodiment, each pump assembly 250, 280 includes three identical, uniformly circumferentially spaced pistons 255 that function in the same manner. Thus, at any given time during rotation of wobbles plate 270, at least one piston 255 of each assembly 250, 280 is being filled with hydraulic fluid and at least one piston 255 of each assembly 250, 280 is providing compressed hydraulic fluid to shuttle valve assembly 130. Accordingly, hydraulic pump 200 continuously provides compressed hydraulic fluid to shuttle valve assembly 130 to drive fluid end pump 110.

Referring again to FIG. 4C, it should be appreciated that wobble plates 270 are counter opposed. Namely, axially outermost point 271*a* on slanted end face 271 of upper wobble plate 270 is circumferentially aligned with axially outermost point 271*a* on slanted end face 271 of lower wobble plate 270. As a result, axially innermost points 271*b* on slanted end faces 271 of upper and lower wobble plates 270 are circumferentially aligned. Such orientation of upper wobble plate 270 relative to lower wobble plate 270 balances axial forces exerted on driveshaft 298 by upper and lower wobble plates 270. In particular, hydraulic fluid being compressed in bores 253, 256 of upper pump assembly 250 exert axially downward forces on end face 271 of upper wobble plate 270 and driveshaft 298. However, hydraulic fluid being compressed in bores 253, 256 of lower pump assembly 280 exert axially equal and opposite (i.e., upward) axial forces on end face 271 of lower wobble plate 270 and driveshaft 298, thereby counteracting the forces exerted on driveshaft 298 by upper wobble plate 270. Such balancing of axial forces on driveshaft 298 reduces axial loads supported by electric motor 300, which drives the rotation of driveshaft 298, thereby offering the potential to improve the durability of motor 300.

Referring still to FIG. 4C, bearing assembly 245 is disposed in bearing chamber 240 and includes a pair of annular radial bearings 246 disposed about driveshaft 298 that radially support rotating driveshaft 298. In general, radial bearings 246 may comprise any suitable type of radial bearings including, without limitation, radial ball bearings.

Referring now to FIG. 4D, electric motor 300 has a first or upper end 300*a* coupled to hydraulic pump 200 and a lower end 300*b* coupled to compensator 350. Motor 300 includes a radially outer housing 310 and a tubular rotor or output driveshaft 320 having an upper end 320*a* coupled to driveshaft 298 previously described. Motor 300 drives the rotation of driveshaft 320, which in turn drives the rotation of driveshaft 298 and wobble plates 270, thereby powering hydraulic pump 200. Tubular conduit 205 extends axially through the coaxially aligned driveshafts 320, 298. Annular radial bearings 330 are disposed about driveshaft 320 at its ends. Bearings 330 are radially positioned between housing 310 and driveshaft 320, and radially support the rotating driveshaft 320.

A controller (not shown), which may be disposed at the surface 11 or downhole, controls the speed of motor 320 in response to sensed pressure at the bottom of wellbore 20. Wires 46 in spoolable tubing 40 provide electricity to power the operation of motor 300.

In general, motor 300 may comprises any suitable type of electric motor that converts electrical energy provided by wires 46 into mechanical energy in the form of rotational torque and rotation of driveshaft 320. Examples of suitable electric motors include, without limitation, DC motors, AC motors, universal motors, brushed motors, permanent magnet motors, or combinations thereof. Due to the potentially high depth applications of deliquification pump 100 (e.g., depths in excess of 10,000 ft.), electric motor 300 is preferably capable of withstanding the relatively high temperatures experienced at such depths. In this embodiment, electric motor 300 is a permanent magnet motor. In addition, in this embodiment, motor housing 310 is filled with hydraulic fluid that can flow to and from hydraulic pump 200 and compensator 350. The hydraulic fluid facilitates heat transfer away from electric motor 300 and lubricates bearings 330. In other embodiments, the electric motor (e.g., motor 300) may include heat dissipation fins extending radially from the motor housing (e.g., housing 310) to enhance the transfer of thermal energy from the electric motor to the surrounding environment.

Referring now to FIGS. 4E and 4F, as previously described, compensator 350 provides a reservoir for hydraulic fluid, accommodates thermal expansion of hydraulic fluid in deliquification pump 100, provides hydraulic fluid for lubrication of motor 300 and hydraulic pump 200, and replenishes hydraulic fluid in pumps 110, 200 that may be lost to the surrounding environment over time (e.g., through leaking seals, etc.). Compensator 350 has a first or upper end 350*a* coupled to electric motor 300 and a second or lower end 350*b* coupled to separator 400. In addition, compensator 350 includes a housing 351 extending axially between ends 350*a, b*, an internal chamber 360 within housing 351, an annular piston 370 disposed within chamber 360, and a biasing assembly 380 axially positioned between piston 370 and end 350*b*. Tubular conduit 205 extends axially through compensator 350, motor 300, and hydraulic pump 200, and provides well fluids 15 from separator 400 to fluid end pump 110.

Housing 351 includes an elongate tubular section 352, a first or upper end cap 353 closing off tubular section 352 at end 350*a* and coupling compensator 350 to motor 300, and a second or lower end cap 354 closing off tubular section 352 at end 350*b*. Conduit 205 extends axially through throughbores 355, 356 in end caps 353, 354, respectively. In addition, upper end cap 353 includes a hydraulic fluid port 357 in fluid communication with motor housing 310, and lower end cap 354 includes a plurality of well fluids ports 358 in fluid communication with separator 400.

Piston 370 is disposed about conduit 205 within chamber 360. In this embodiment, piston 370 includes a piston body 371 extending radially from conduit 205 to housing 351 and a tubular member 372 extending axially from piston body 371 toward end 350*b*. Piston body 371 slidingly engages both conduit 205 and housing 351, and divides chamber 360 into a first or upper chamber section 360*a* extending axially from upper end cap 353 to piston 370 and a second or lower chamber section 360*b* extending axially from piston 370 to lower end cap 354. In this embodiment, piston body 371 includes two axially spaced radially inner annular seals 373 that sealingly engage conduit 205, and two axially spaced radially outer annular seals 374 that sealingly engage housing tubular section 352. Seals 373, 374 restrict and/or prevent fluid communication between chamber sections 360*a, b*. Chamber section 360*a* is filled with hydraulic fluid and chamber section 360*b* is filled with well fluids 15 from separator 400 via ports 358. Thus, as piston 370 moves axially within chamber 360 and the volume of section 360*b* changes, well fluids 15 are free to move between section 360*b* and separator 400 via ports 358. The remainder of well fluids 15 output from separator 400 pass through conduit 205 to fluid end pump 110.

Tubular member 372 is disposed about biasing assembly 380 and defines a minimum axial distance between piston body 371 and lower end cap 354, thereby defining a maximum volume of chamber section 360*a*. In general, piston 370 is generally free to move axially within chamber 360; when piston 370 moves axially toward end cap 353, the volume of section 360*a* decreases and the volume of section 360*b* increases, and when piston 370 moves axially toward end cap 354, the volume of section 360*a* increases and the volume of section 360*b* decreases. However, tubular member 372 limits the axial movement of piston 370 toward end cap 354. Specifically, once tubular member 372 axially abuts end cap 354, piston 370 is prevented from moving axially downward. In this embodiment, tubular member 372 is sized to abut end cap 354 when biasing assembly 380 is fully compressed.

Referring still to FIGS. 4E and 4F, biasing assembly 380 biases piston 370 axially upward toward end 350*a*. In this embodiment, biasing assembly 380 includes a plurality of axially spaced biasing members 381 and a plurality of annular biasing member guides 382, one guide 382 axially disposed between each pair of axially adjacent biasing members 381. Biasing members 381 and guides 382 are disposed about conduit 205 and are axially positioned between piston body 371 and end cap 354. In this embodiment, biasing members 381 are coil springs and guides 382 function to maintain the radial position and coaxial alignment of the coil springs 381, thereby restricting and/or preventing springs 381 from buckling within chamber section 360*b*.

Piston 370 is a free floating balance piston that moves in response to differences between the axial force applied by the hydraulic fluid pressure in section 360*a*, and the axial forces applied by biasing assembly 380 and well fluids pressure in section 360*b*. Specifically, piston 370 will axially within chamber 360 until these axial forces are balanced. For example, if the pressure of hydraulic fluid in section 360*a* increases, piston 370 will move axially downward (expanding the volume of section 360*a*) until the axial forces acting on piston 370 are balanced; and if the pressure of hydraulic fluid in section 360*a* decreases, piston 370 will move axially upward (decreasing the volume of section 360*a*) until the axial forces acting on piston 370 are balanced. The hydraulic fluid in chamber section 360*a* is in fluid communication with motor housing 310 via end cap port 357, and is in fluid communication with hydraulic pump chambers 220, 230, 240 via clearances between pump housing end cap 213 and driveshaft shaft 298. Accordingly, if the volume, and associated pressure, of hydraulic fluid in pump 200, motor 300, and/or compensator 350 increases, it can be accommodated by compensator 350. Conversely, if the volume, and associated pressure, of hydraulic fluid in pump 200, motor 300, and/or compensator decreases (e.g., if any hydraulic fluid is lost due to seal leaks etc.), it can be replenished by hydraulic fluid from compensator 350.

Referring now to FIGS. 3 and 4G, separator 400 has a first or upper end 400*a* coupled to compensator lower end cap 354, and a second or lower end 400*b* opposite end 400*a*. Although separator 400 is shown horizontally in FIG. 4G, separator 400 is deployed in a vertical orientation as it relies on gravity to aid in separating particulate matter and solids from well fluids 14. Moving axially from upper end 400*a* to lower end 400*b*, in this embodiment, separator 400 includes a coupling 410, a cyclonic separation assembly 420, a first or upper solids collection assembly 450, a second or lower solids collection assembly 450', and a solids outlet tubular 480 coupled together end-to-end. Coupling 410, cyclonic separation assembly 420, upper solids collection assembly 450, lower solids collection assembly 450', and screen 480 are coaxially aligned, each having a central axis coincident with axis 105.

Coupling 410 connects separator 400 to compensator 350 and has a first or upper end 410*a* coupled to compensator end cap 354 and a second or lower end 410*b* secured to cyclonic separation assembly 420. In this embodiment, coupling 410 includes a frustoconical recess 411 extending axially from upper end 410*a*, and a throughbore 412 extending axially from recess 411 to lower end 410*b*. A vortex tube 413 in fluid communication with bore 412 extends axially downward from lower end 410*b* into cyclonic separation assembly 420. Recess 411, bore 412, and tube 413 are coaxially aligned with axis 405, and together, define a flow passage 415 that extends axially through coupling 410 and into assembly 420. As will be described in more detail below, processed well fluids 15 flow from separation assembly 420 through passage 415 into device 30. Thus, passage 415 may also be referred to as a processed fluid outlet.

Referring still to FIG. 4G, cyclonic separation assembly 420 includes a radially outer housing 421, an intake member 430, and a cyclone body 440. Tubular housing 421 has a first or upper end 421*a* secured to lower end 410*b* of coupling 410, a second or lower end 421*b* secured to solids collection assembly 450, and a uniform inner radius $R_{421}$. In addition, housing 421 includes a plurality of circumferentially spaced separator inlet ports 422 at lower end 421*b*. In this embodiment, four uniformly spaced inlet ports 422 are provided. However, in other embodiments, one, two, three or more inlet ports (e.g., ports 422) may be included in the cyclone assembly housing (e.g., housing 421). As will be described in more detail below, during operation of separator 400, unprocessed well fluids 14 in wellbore 20 are enter separator 400 via inlet ports 422.

Figure 11:
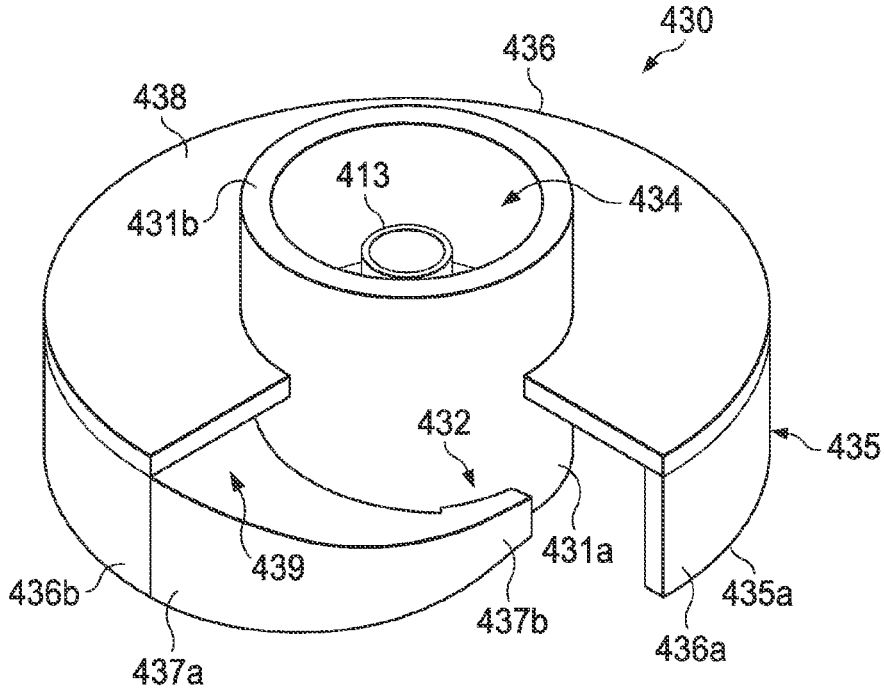
FIG. 11 is a top perspective view of the cyclone intake of FIG. 4G.
Figure 12:
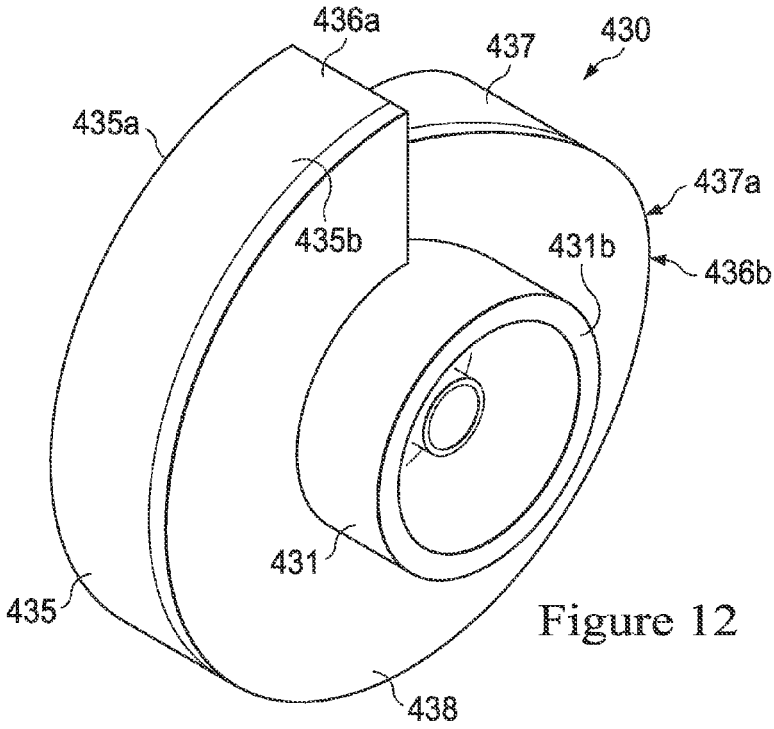
FIG. 12 is a bottom perspective view of the cyclone intake of FIG. 4G.

Referring now to FIGS. 4G and 10-13, intake member 430 is coaxially disposed in upper end 421*a* of housing 421 and extends axially from lower end 410*b* of coupling 410. In this embodiment, intake member 430 includes a feed tube 431 and an elongate fluid guide member 435 disposed about feed tube 431. Feed tube 431 is coaxially disposed about and radially spaced from vortex tube 413. Consequently, an annulus 434 is formed radially between tubes 413, 431. In addition, feed tube 431 has a first or upper end 431*a* engaging lower end 410*b*, a second or lower end 431*b* distal coupling 410, an outer radius $R_{431}$, and a length $L_{431}$ measured axially between ends 431*a, b*. As best shown in FIG. 11, feed tube 431 also includes a cyclone inlet port 432 at upper end 431*a*. Port 432 extends radially through tube 431 and is in fluid communication with annulus 434.

Figure 13:
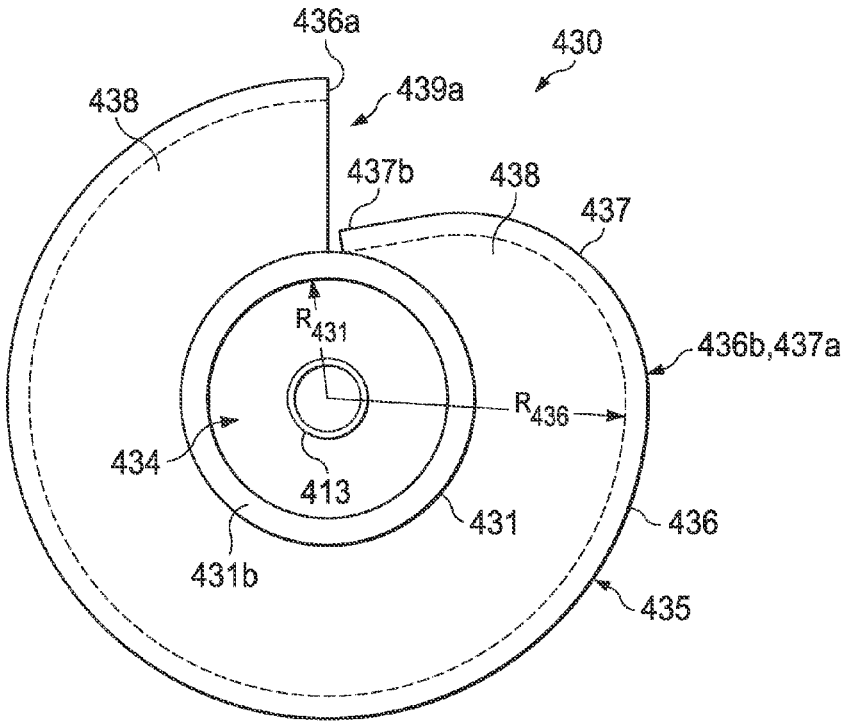
FIG. 13 is a bottom view of the cyclone intake of FIG. 4G.

Guide member 435 has a first or upper end 435*a* engaging coupling lower end 410*b* and a second or lower end 435*b* distal coupling 410. In this embodiment, guide member 435 is an elongate thin-walled structure oriented parallel to feed tube 431. Guide member 435 may be divided into a first section or segment 436 disposed at a uniform radius $R_{436}$ that is greater than radius $R_{431}$ of feed tube 431, and a second section or segment 437 that extends from first segment 436 and curves radially inward to feed tube 431. Thus, guide member 435 is disposed about feed tube 431 and generally spirals radially inward to feed tube 431. As best shown in FIG. 13, first segment 436 extends circumferentially through angular distance of about 270° between a first end 436*a* generally radially aligned with inlet port 436 of feed tube 431 and a second end 436*b*. Thus, segment 436 wraps around about 75% of the way around feed tube 431.

Referring again to FIGS. 4G and 10-13, second segment 437 has a first end 437*a* contiguous with second end 436*b* of first segment 436 and a second end 437*b* that engages feed tube 431. Thus, first end 437*a* is disposed at radius $R_{436}$, however, second end 437*b* is disposed at radius $R_{431}$. Consequently, moving from end 437*a* to end 437*b*, second segment 437 curves radially inward toward feed tube 431. First end 437*a* is circumferentially positioned to one side of inlet port 436, and second end 437*b* is circumferentially positioned on the opposite side of inlet port 436. Thus, second segment 437 extends circumferentially across inlet port 436.

A base member 438 extends radially from guide member 435 to feed tube 431, thereby enclosing guide member 435 at lower end 435*b* and defining a spiral flow passage 439 within intake member 430. In other words, base 438, lower end 410*b* of coupling 410, and guide member 435 define spiral flow passage 439, which extends from an inlet 439*a* at end 436*a* to feed tube port 432. In FIG. 11, the portion of base member 438 extending between section 437 and feed tube 431 has been omitted to more clearly illustrate port 432.

First segment 436 has a uniform height $H_{436}$ measured axially from end 435*a* to base member 438, and second segment 437 has a variable height $H_{437}$ measured axially from end 435*a* to base member 438. Thus, between ends 436*a,b* of first segment 436, base member 438 is generally flat, however, moving from end 437*a* to end 437*b* of second segment 437, base member 438 curves upward. Height $H_{436}$ is less than height $H_{431}$, and thus, feed tube 431 extends axially downward from guide member 435. Further, in this embodiment, height $H_{437}$ is equal to height $H_{436}$ at end 437*a*, but linearly decreases moving from end 437*a* to end 437*b*. The decrease in height $H_{437}$ moving from end 437*a* to end 437*b* causes fluid flow through passage 439 to accelerate into port 432.

During operation of separator 400, well fluids 14 enter housing 421 through separator inlet ports 422, and flow axially upward within housing 421 and into passage 439 of cyclone intake member 430 via inlet 439*a*. Flow passage 439 guides well fluids 14 circumferentially about feed tube 431 toward feed tube port 432. As the radial distance between guide member 435 and feed tube 431 decreases along second segment 437, well fluids 14 in passage 439 are accelerated and directed through feed tube port 432 into feed tube 431. As best shown in FIG. 13, second segment 437 is oriented generally tangent to feed tube 431. Thus, second segment 437 directs well fluids 14 "tangentially" into feed tube 431 (i.e., in a direction generally tangent to the radially inner surface of feed tube 431). This configuration facilitates the formation of a spiraling or cyclonic fluid flow within feed tube 431. Vortex tube 413 extending coaxially axially through feed tube 431 is configured and positioned to enhance the formation of a vortex and resulting cyclonic fluid flow within feed tube 431.

Figure 14:
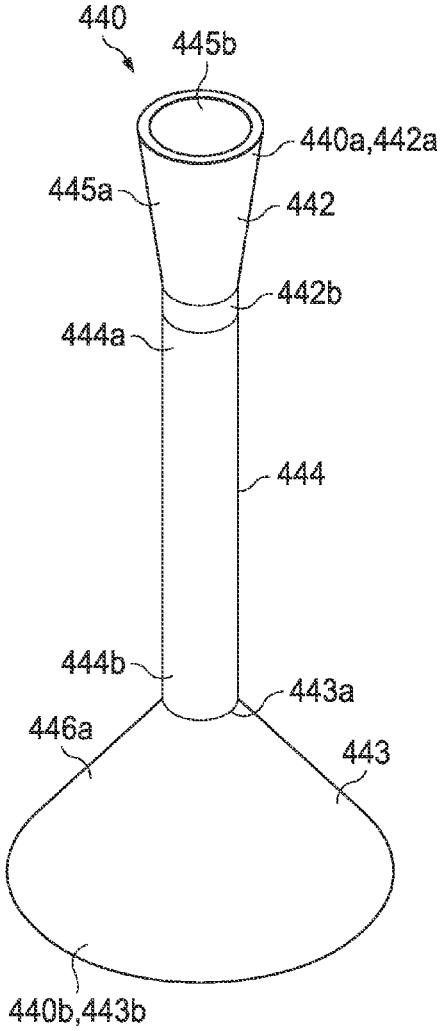
FIG. 14 is a perspective view of the separator cyclone of FIG. 4G.
Figure 15:
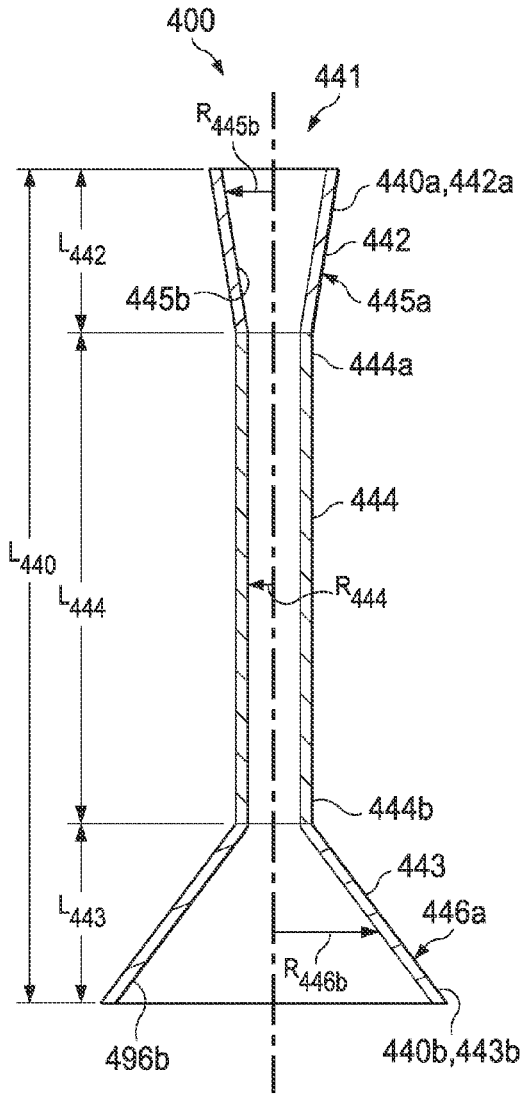
FIG. 15 is a cross-sectional view of the separator cyclone of FIG. 4G.

Referring now to FIGS. 4G, 14, and 15, cyclone body 440 is coaxially disposed in housing 421 and extends axially from lower end 431*b* of feed tube 431. Cyclone body 440 has a first or upper end 440*a* engaging feed tube lower end 431*b*, a second or lower end 440*b* distal feed tube 431, a central flow passage 441 extending axially between ends 440*a, b*, and a length $L_{440}$ measured axially between ends 440*a, b*. Lower end 440*b* is axially aligned with housing lower end 421*b* and extends radially outward to housing lower end 421*b*. The remainder of cyclone body 440 is radially spaced from housing 421, thereby defining an annulus 447 radially positioned between cyclone body 440 and housing 421.

In this embodiment, cyclone body 440 includes an upper converging member 442 extending axially from end 440*a*, a lower diverging member 443 extending axially from end 440*b*, and a intermediate tubular member 444 extending axially between members 442, 443. Each member 442, 443, 444 has a first or upper end 442*a*, 443*a*, 444*a*, respectively, and a second or lower end 442*b*, 443*b*, 444*b*, respectively.

Tubular member 444 is an elongate tube having a length $L_{444}$ measured axially between ends 444*a, b*, and a constant or uniform inner radius $R_{444}$ along its entire length $L_{444}$. Converging member 442 has a frustoconical radially outer surface 445*a* and a frustoconical radially inner surface 445*b* that is parallel to surface 445*a*. In addition, converging member 442 has a length $L_{442}$ measured axially between ends 442*a, b*, and an inner radius $R_{445b}$ that decreases linearly moving downward from end 442*a* to end 442*b*. In particular, radius $R_{445b}$ is equal to inner radius $R_{431}$ of feed tube 431 at upper end 442*a*, and equal to inner radius $R_{444}$ of tubular member 444 at end 442*b*.

Lower diverging member 443 has a frustoconical radially outer surface 446*a* and a frustoconical radially inner surface 446*b* that is parallel to surface 446*a*. In addition, diverging member 443 has a length $L_{443}$ measured axially between ends 443*a, b*, and an inner radius $R_{446b}$ that increases linearly moving downward from end 443*a* to end 443*b*. In particular, radius $R_{446b}$ is equal to inner radius $R_{431}$ of feed tube 431 at upper end 443*a*, and slightly less than inner radius $R_{421}$ of housing 421 at end 443*b*. The dimensions of members 442 and 444 are fundamental to strength of the cyclone formed within the device.

Figure 16:
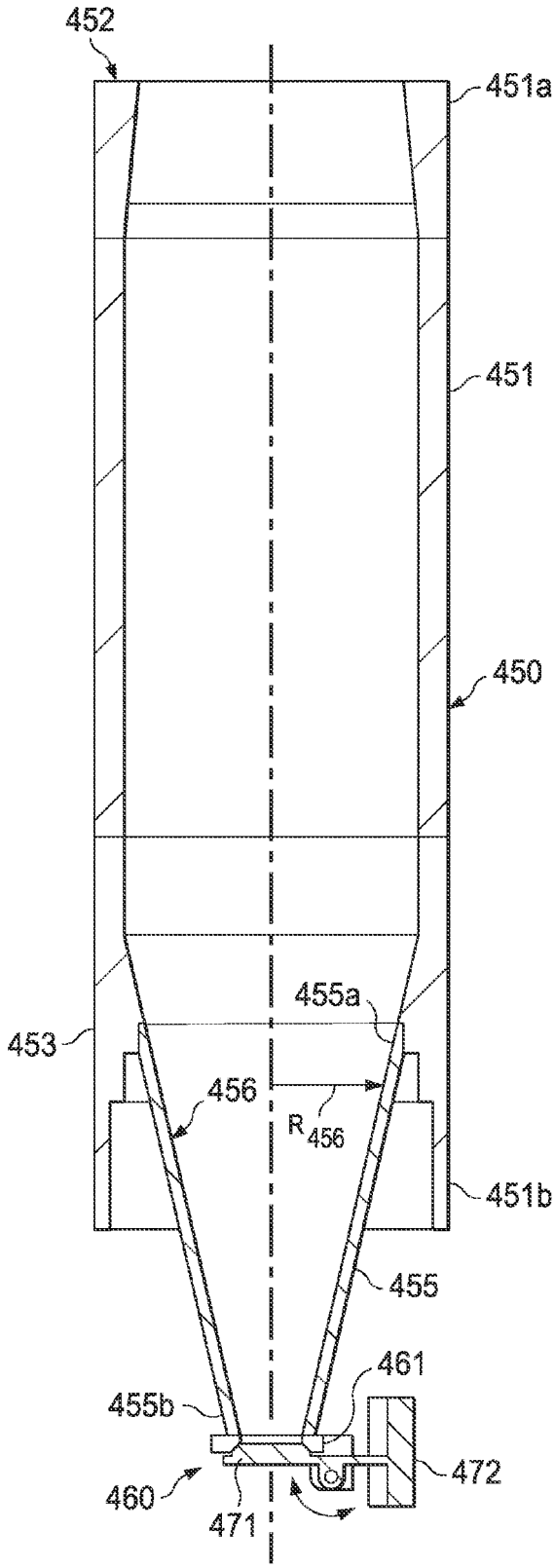
FIG. 16 is a cross-sectional view of one of the solids collection assemblies of FIG. 4G.

Referring now to FIGS. 4G and 16, upper solids collection assembly 450 includes a tubular housing 451, a funnel or converging member 455 coaxially disposed within housing 451, and a trap door assembly 460 coupled to converging member 455. Housing 451 has a first or upper end 451*a* coupled to lower end 421*b* of cyclone housing 421 and a second or lower end 451*b* coupled to lower solids collection assembly 450'. Upper end 451*a* defines an annular shoulder 452 that extends radially inward relative to lower end 421*b*. Lower end 440*b* of cyclone body 440 engages shoulder 452. In addition, housing 451 includes a radially inner annular shoulder 453 disposed between ends 451*a, b*. In this embodiment, housing 451 is formed from a plurality of tubular member coaxially coupled together end-to-end.

Converging member 455 has an upper end 455*a* that axial abuts annular shoulder 453 and a lower end 455*b* disposed axially below housing lower end 451*b*. Thus, member 455 is disposed within and extends axially from housing 451. Converging member 455 has a frustoconical radially inner surface 456 disposed at a radius $R_{456}$ that decreases moving axially downward from end 455*a* to end 455*b*.

Figure 17:
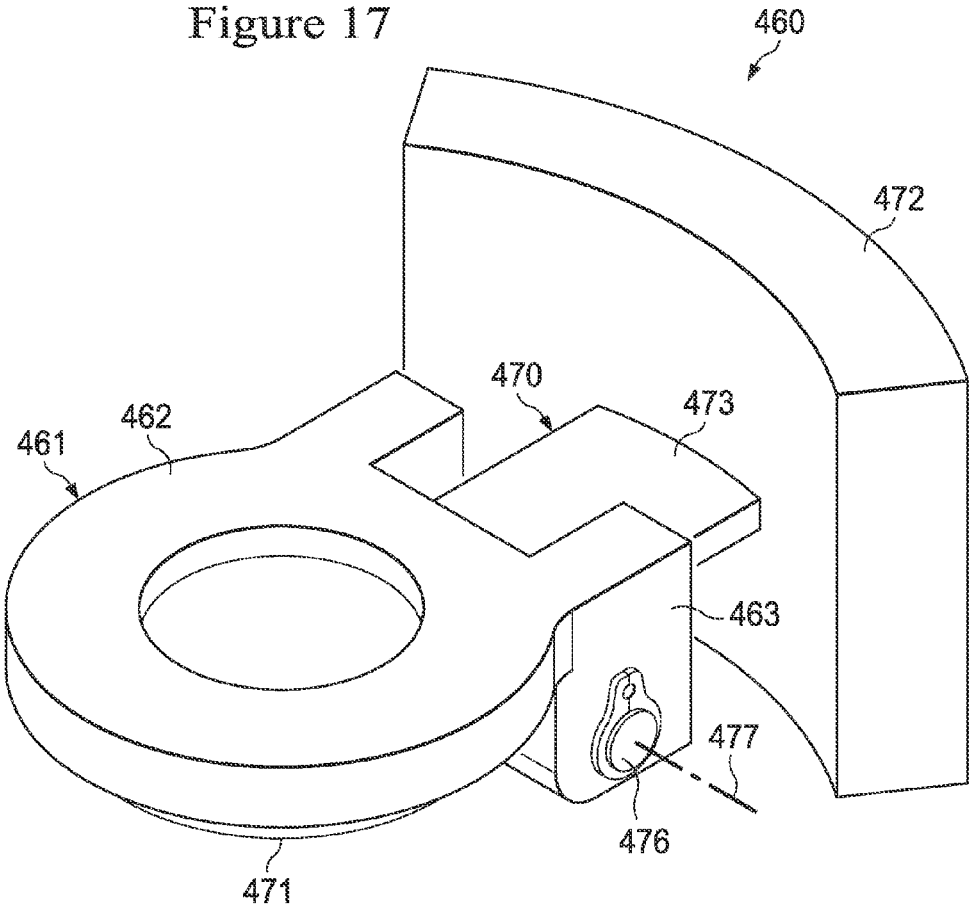
FIG. 17 is an enlarged perspective view of the trap door assembly of FIG. 16.
Figure 18:
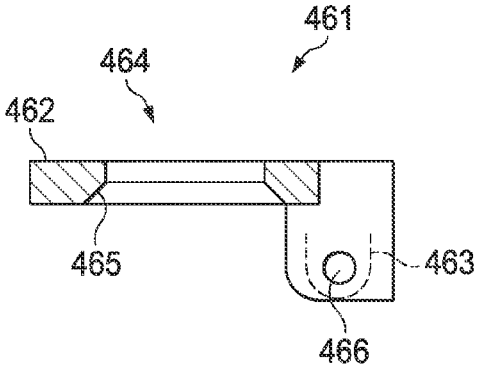
FIG. 18 is a cross-sectional side view of the base member of the trap door assembly of FIG. 11.
Figure 19:
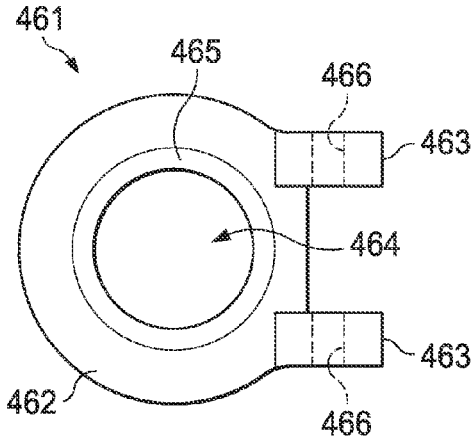
FIG. 19 is a bottom view of the base member of the trap door assembly of FIG. 17.

Referring now to FIGS. 16-21, trap door assembly 460 includes base member 461 coupled to converging member lower end 455*b* and a rotating member 470 rotatably coupled to base member 461. As best shown in FIGS. 17-19, base member 461 comprises an annular flange 462 and a pair of parallel arms 463 extending axially downward from flange 462. Flange 462 is fixed to lower end 455*b* of converging member 455 and has a throughbore 464 in fluid communication with converging member 455. Bore 464 includes an annular shoulder or seat 465. Arms 463 are positioned radially outward of bore 464 and include aligned holes 466.

Figure 20:
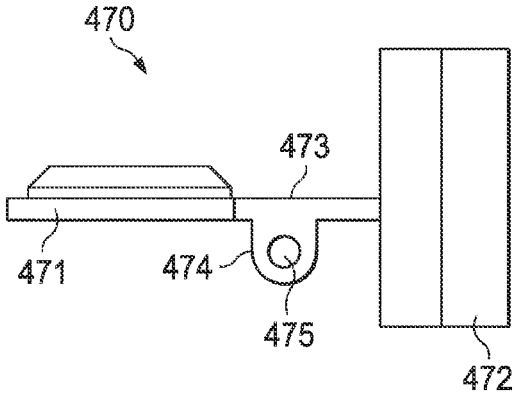
FIG. 20 is a side view of the rotating member of the trap door assembly of FIG. 17.
Figure 21:
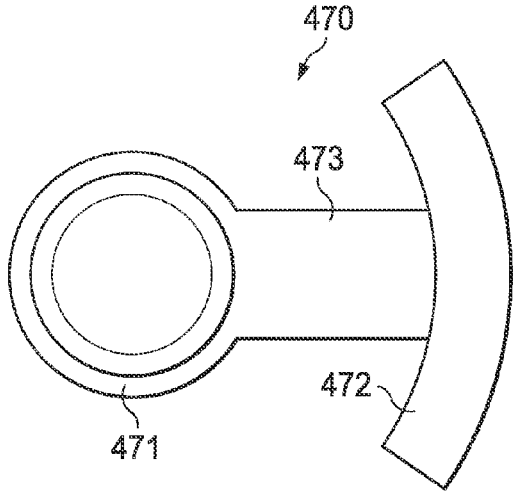
FIG. 21 is a top view of the rotating member of the trap door assembly of FIG. 17.

As best shown in FIGS. 17, 20, and 21, rotating member 470 includes a circular door 471 and a counterweight 472 connected to door 471 with a lever arm 473. Door 471 is adapted to move into and out of engagement with seat 465, thereby closing and opening bore 464, respectively. In particular, a pair of parallel arms 474 extend downward from lever arm 473. Arms 474 are positioned between door 471 and counterweight 472, and include aligned holes 475. Lever arm 473 is disposed between arms 463 of base member 461, holes 466, 475 are aligned, and door 471 is positioned just below flange 462. A shaft 476 having a central axis 477 extends through holes 466, 475, thereby rotatably coupling rotating member 470 to base member 461.

Referring again to FIGS. 16 and 17, rotating member 470 is allowed to rotate relative to base member 461 about shaft axis 477, thereby moving door 471 into and out of engagement with seat 465 and transitioning door 471 and assembly 460 between a "closed" and an "opened" position. In particular, when trap door assembly 460 and door 471 are closed, door 471 engages seat 465), thereby obstructing bore 464 and restricting and/or preventing movement of fluids and solids between solids collection assemblies 450, 450'. However, when trap door assembly 460 and door 471 are opened, door 471 is swung downward out of engagement with seat 465, thereby allowing movement of fluids and solids between solids collection assemblies 450, 450'. In this embodiment, counterweight 472 biases door 471 to the closed position engaging seat 465, however, if an axially downward load applied to door 471 is sufficient to overcome counterweight 472, rotating member 470 will rotate about axis 477 and swing door 471 downward and out of engagement with seat 465.

Referring again to FIGS. 4G and 16, lower solids collection assembly 450' is coupled to lower end 451*b* of upper collection assembly housing 451. In this embodiment, lower solids collection assembly 450' is the same as upper solids collection assembly 450 previously described. Namely, lower solids collection assembly 450' includes a tubular housing 451, an converging member 455, an trap door assembly 460. However, upper end 451*a* of housing 451 of lower solids collection assembly 450' does not extend radially inward relative to the remainder of housing 451 of lower solids collection assembly 450'. Further, in this embodiment, counterweight 472 of lower assembly 450' has a different weight than counterweight 472 of upper assembly 450. In particular, counterweight 472 of lower assembly 450' weighs more than counterweight 472 of upper assembly 450. Consequently, trap door assemblies 460 of assemblies 450, 450' are generally designed not to be open at the same time (i.e., when trap door assembly 460 of assembly 450 is open, trap door assembly 460 of assembly 450' is closed, and vice versa).

Referring now to FIG. 4G, solids outlet tubular 480 is coupled to lower end 451*b* of housing 451 of lower solids collection assembly 450' and extends axially downward to end 400*b*. In this embodiment, a screen 481 including a plurality of holes 482 is coupled to tubular 480 at lower end 480. Holes 482 allows separated solids that pass through lower solids collection assembly 450' into tubular 480 to fall under the force of gravity from lower end 400*b* of separator 400.

Figure 22:
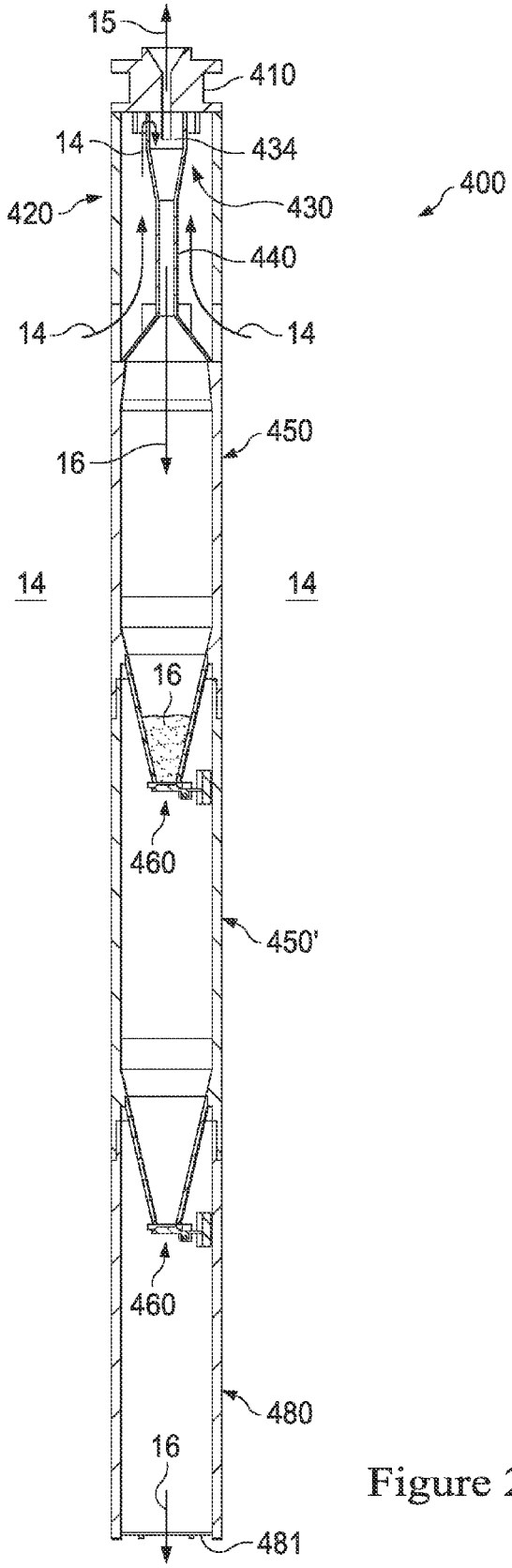
FIG. 22 is a schematic cross-sectional illustration of the operation of the separator of FIG. 4G.

Referring now to FIGS. 1 and 22, as deliquification pump 100 is lowered downhole with tubing 40, separator 400 is submerged in well fluids 14. As a result, separator 400 is initially filled and surrounded by well fluids 14. Once downhole operations begin, a low pressure region is formed within passage 415 at upper end 400*a* of separator 400 by fluid end pump 110. Passage 415 is in fluid communication with inner passage 441 of cyclone body 440 and annulus 434 between tubes 413, 431. In addition, passage 415 is in fluid communication with annulus 447 via feed tube port 432. Thus, the low pressure region in passage 415 generally seeks to (a) pull well fluids 14 in passage 441 upward toward passage 415; (b) pull well fluids 14 in annulus 434 downward toward the lower end of vortex tube 413 and passage 415; and (c) pull well fluids in annulus 447 axially upward to port 432. Well fluids 14 in annulus 447 can be pulled through port 432 and downward within annulus 434 to the lower end of vortex tube 413 and passage 415, however, well fluids 14 in passage 441 are restricted and/or prevented from being sucked into passage 415. In particular, trap door assembly 460 of upper solids collection assembly 450 is biased closed, and thus, collection assembly 450 functions like a sealed tank—suction of any well fluids 14 upward from collection assembly 450 will result in formation of a low pressure region in collection assembly 450 that restricts and/or prevents further suction of well fluids 14 from collection assembly 450.

Well fluids 14 flow into cyclonic separation assembly 420 via ports 422, and upon entering cyclonic separation assembly 420, flow axially upward within annulus 447 to cyclone intake member 430. At intake member 430, well fluids 14 enter spiral flow passage 439 at inlet 439*a*. Flow passage 439 guides well fluids 14 circumferentially about feed tube 431 toward feed tube port 432 and accelerates well fluids 14 therein as they approach port 432. Well fluids 14 flow tangentially into feed tube 431 and are partially aided by vortex tube 413 to form a cyclonic or spiral flow pattern within feed tube 431. As well fluids 14 spiral within feed tube 431, they also moves axially downward towards the lower end of vortex tube 413 under the influence of the low pressure region in passage 415.

The solids and particulate matter in well fluids 14 with sufficient inertia, designated as solids 16, begin to separate from the liquid and gaseous phases in well fluids 14 and move radially towards the inner surface of feed tube 431. Eventually solids 16 strike the inner surface of feed tube 431 and fall under the force of gravity into converging member 442. The liquid and gaseous phases in well fluids 14, as well as the relatively low inertia particles remaining therein, (i.e., processed well fluids 15) continue their cyclonic flow in feed tube 431 as they move towards the lower end of vortex tube 413. When processed well fluid 15 reach the lower end of vortex tube 413, they are sucked in passage 415 and are ejected from separator 400 into conduit 205 and flow to fluid end pump 110.

After separation, solids 16 fall through passage 441 of cyclone body 440 under the force of gravity into upper solids collection assembly 450. Trap door assembly 460 is normally biased to the closed position, however, when the accumulation of solids 16 in funnel 455 applies a sufficient load to door 471, trap door assembly 460 will open and allow solids 16 to fall through bore 464 into lower solids collection assembly 450'. Similar to upper solids collection assembly 450, trap door assembly 460 of lower solids collection assembly 450' is normally biased to the closed position. However, when the accumulation of solids 16 in funnel 455 applies a sufficient load to door 471, trap door assembly 460 opens and allow solids 16 to fall through bore 464 into tubular 481. Solids 16 continue to fall downward and pass through holes 482 in screen 480, thereby exciting separator 400.

Disruption of the cyclonic flow of well fluids 14 in feed tube 431 may negatively impact the ability of separator 400 to separate solids 16 from well fluids 14. However, the use of two trap door assemblies 460 in a serial arrangement offers the potential to minimize the impact on the cyclonic flow within feed tube 431. In particular, the low pressure region in passage 415 has a tendency to pull fluids in passage 441 and housing 451 of upper solids collection assembly 450 upward into vortex tube 413. However, since trap door assembly 460 of upper solids collection assembly 450 is biased closed, upward fluid flow in passage 441 and housing 451 is restricted and/or prevented. Namely, when trap door assembly 460 is closed, passage 441 and housing 451 of upper solids collection assembly 450 function like a sealed tank, if fluid is pulled upward from passage 441 and housing 451*a* vacuum is created therein which works against such upward fluid flow. As the weight of solids 16 in upper solids collection assembly 450 overcome counterweight 472, trap door assembly 460 opens and allows solids 16 to fall from upper solids collection assembly 450 to lower solids collection assembly 450'. This temporarily allows fluid communication between passage 415 and both housings 451 of assemblies 450, 450'. However, as previously described, trap door assemblies 460 are configured such that each is not opened at the same time. Thus, when trap door assembly 460 of upper assembly 450 is open, trap door assembly 460 of lower assembly 450' is closed. Consequently, when trap door assembly 460 of upper assembly 450 is temporarily opened to allow solids 16 to pass into lower assembly 450', upward fluid flow in passage 441 and housings 451 is restricted and/or prevented. Namely, when trap door assembly 460 of upper assembly 450 is open, passage 441 and housings 451 function like a sealed tank.

When trap door assembly 460 of assembly 450 is open, solids 16 fall from upper assembly 450 into lower assembly 450'. Trap door assembly 460 of lower assembly 450' remains closed as solids 16 fall therewithin. Once a sufficient quantity of the solids in funnel 455 of upper assembly 450 have passed bore 464, trap door assembly 460 of upper assembly 450 will again close. The solids 16 begin to accumulate within funnel 455 of lower assembly 450' until the load on door 471 of lower assembly 450' is sufficient to overcome counterweight 472 of lower assembly 450'. In the manner described, upward fluid flow in passage 441 and housings 451 into passage 415 is restricted and/or prevented. As a result, disruption of cyclonic flow of well fluids 14 in feed tube 431 is minimized and/or eliminated.

In this embodiment, separator 400 is designed for substantially vertical deployment. In substantially horizontal deployment of the deliquification pump (e.g., pump 100), separator 400 may be eliminated and replaced with a different type of separator capable of operation in a substantially horizontal orientation, inlet screens or filters, or combinations thereof.

Referring now to FIGS. 1, 3, and 4A-4G, deliquification pump 100 is deployed by rigless deployment vehicle 30 to lift well fluids 14 from the bottom of relatively low pressure wellbore 20 to enhance production. Alternatively, pump 100 may be deployed on standard oilfield jointed tubulars with the use of a conventional workover rig. Well fluids 14, which may include solid, liquid, and gas phases, are sucked from the bottom of wellbore into separator 400, which removes at least a portion of the solids from well fluids 14 and outputs substantially solids-free well fluids 15 (i.e., well fluids 14 minus the portion of the solids removed by separator 400). Well fluids 15 output from separator 400 are sucked into fluid end pump 110 via conduit 205, which passes through compensator 350, motor 300, and hydraulic pump 200, and well fluids conduit 116 in distributor 115. This arrangement serves as another means for removing heat from motor 300 and hydraulic pump 200 as the well fluid 15 passes through the interior of motor 300 and hydraulic pump 200. In particular, this arrangement forces countercurrent flow of well fluids 15 upward through the center of motor 300 and hydraulic pump 200, and hydraulic fluid downward about conduit 205 through motor 300 and hydraulic pump 200, thereby offering the potential for enhanced cooling. This design also eliminates the radially outer shroud commonly used in most conventional electric submersible pumps, which limits the minimum pump outside diameter and minimum size casing through which the pump can be deployed. Further, the center well fluid 15 flow design disclosed herein provides a direct, unrestricted path to fluid end pump 110. Well fluids 15 supplied to fluid end pump 110 enter pump sections 121*a*, 125*a* via inlet valves 520 of upper and lower valve assemblies 500, 500', and are pumped to the surface 11 through coupling 45 and tubing 40.

Fluid end pump 110 is driven by hydraulic pump 200, and hydraulic pump 200 is driven by electric motor 300. Conductors 46 in spoolable tubing 40 provide electrical power downhole to motor 300, which powers the rotation of motor driveshaft 320, hydraulic driveshaft 298, and wobble plates 270. As plates 270 rotate, hydraulic fluid in pump chambers 220, 230 is cyclically supplied to pistons 255 via slots 272, compressed in pistons 255, and then passed to shuttle valve assembly 130 of fluid end pump 110 via branches 215, 216 and passages 214, 117, 113. Shuttle valve assembly 130 alternates the supply of compressed hydraulic fluid to chamber sections 121*b*, 125*b*, thereby driving the reciprocation of fluid end pump pistons 122, 126. Use of hydraulic pump 200 in conjunction with fluid end pump 110 offers the potential to generate the relatively high fluid pressures necessary to force or eject relatively low volumes of well fluids 15 to the surface 11. In particular, hydraulic pump 200 converts mechanical energy (rotational speed and torque) into hydraulic energy (reciprocating pressure and flow), and is particularly deigned to generate relatively high pressures at relatively low flowrates and at relatively high efficiencies. The addition of fluid end pump 110 allows for an isolated closed loop hydraulic pump system while limiting wellbore fluid exposure to fluid end pump 110. This offers the potential for improved durability and reduced wear. The fluid end pump only has minor hydraulic losses and for the most part is a direct relationship to the pressure output of the hydraulic system. In addition, the variable speed output capability of the system allows for variable pressure and flow output of the fluid end pump.

In general, the various parts and components of deliquification pump 100 may be fabricated from any suitable material (s) including, without limitation, metals and metal alloys (e.g., aluminum, steel, inconel, etc.), non-metals (e.g., polymers, rubbers, ceramics, etc.), composites (e.g., carbon fiber and epoxy matrix composites, etc.), or combinations thereof. However, the components of pump 100 are preferably made from durable, corrosion resistant materials suitable for use in harsh downhole conditions such steel. Although deliquification pump 100 is described in the context of deliquifying gas producing wells, it should be appreciated that embodiments of deliquification pump 100 described herein may also be used in oil wells.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A deliquification pump for deliquifying a well, comprising:

a fluid end pump adapted to pump a fluid from a wellbore;

a hydraulic pump adapted to drive the fluid end pump, the hydraulic pump having a central axis and including a housing having a first internal pump chamber and a first pump assembly disposed in the first chamber;

a fluid conduit extending axially through the hydraulic pump, wherein the fluid conduit is adapted to supply the fluid to the fluid end pump;

wherein the first pump assembly includes:

a piston adapted to reciprocate axially relative to the housing, wherein the piston has a first end, a second end opposite the first end, and a throughbore extending between the first end and the second end;

a first wobble plate including a planar end face axially adjacent the second end of the piston and a slot extending axially through the first wobble plate, wherein the slot is disposed at a uniform radius from the central axis and the end face is oriented at an acute angle relative to the central axis;

wherein the first wobble plate is adapted to rotate about the central axis relative to the housing to axially reciprocate the piston and cyclically place the throughbore of the piston in fluid communication with the slot.

2. The pump of claim 1, wherein the first pump assembly further comprises a swivel plate having a flange parallel to the end face of the first wobble plate and axially spaced from the end face of the first wobble plate;

wherein the piston extends axially through a bore in the flange; and wherein the swivel plate is adapted to pivot relative to housing as the first wobble plate is rotated.

3. The pump of claim 2, wherein the swivel plate is biased axially towards the first wobble plate.

4. The pump of claim 3, wherein the first pump assembly further comprises a guide member including a throughbore, wherein the piston slidingly engages the throughbore of the guide member.

5. The pump of claim 4, wherein the guide member includes a recess extending axially from an end of the guide member;

wherein the first pump assembly further comprises a biasing sleeve slidingly received by the recess and a biasing member disposed in the recess and axially positioned between the biasing sleeve and the guide member;

wherein an end of the biasing sleeve includes an annular seat;

wherein the swivel plate includes an annular convex surface pivotally seated in the annular seat.

6. The pump of claim 1, wherein the throughbore of the piston is in fluid communication with a passage in the housing, and wherein a check valve allows one-way fluid flow from the throughbore of the piston into the passage.

7. The pump of claim 1, wherein the first pump assembly includes:

a plurality of pistons, each piston adapted to reciprocate axially relative to the housing, wherein each piston has a first end, a second end opposite the first end, and a throughbore extending between the first end and the second end;

wherein the first wobble plate is adapted to rotate about the central axis relative to each piston and cyclically place the throughbore of each piston in fluid communication with the slot.

8. The pump of claim 7, wherein the flange of the swivel plate includes a plurality of circumferentially spaced bores, and wherein one piston extends axially through each bore in the flange.

9. The pump of claim 1, wherein the housing includes a second internal pump chamber axially spaced from the first internal pump chamber;

wherein a second pump assembly is disposed in the second internal pump chamber of the hydraulic pump;

wherein the second pump assembly includes:

a piston adapted to reciprocate axially relative to the housing, wherein the piston has a first end, a second end opposite the first end, and a throughbore extending between the first end and the second end;

a second wobble plate including a planar end face axially adjacent the second end of the piston of the second pump assembly and a slot extending axially through the second wobble plate, wherein the slot in the second wobble plate is disposed at a uniform radius from the central axis and the end face of the second wobble plate is oriented at an acute angle relative to the central axis;

wherein the second wobble plate is adapted to rotate about the central axis relative to the housing to axially reciprocate the piston of the second pump assembly and cyclically place the throughbore of the piston of the second pump assembly in fluid communication with the slot of the second wobble plate.

10. The pump of claim 9, wherein the first and second wobble plates are counter-opposed.

11. A deliquification pump for deliquifying a well, comprising:

a fluid end pump adapted to pump a fluid from a wellbore;

a hydraulic pump adapted to drive the fluid end pump, the hydraulic pump having a central axis and including a housing having a first internal pump chamber and a first pump assembly disposed in the first chamber;

wherein the first pump assembly includes:

a piston adapted to reciprocate axially relative to the housing, wherein the piston has a first end, a second end opposite the first end, and a throughbore extending between the first end and the second end;

a first wobble plate including a planar end face axially adjacent the second end of the piston and a slot extending axially through the first wobble plate, wherein the slot is disposed at a uniform radius from the central axis and the end face is oriented at an acute angle relative to the central axis;

wherein the first wobble plate is adapted to rotate about the central axis relative to the housing to axially reciprocate the piston and cyclically place the throughbore of the piston in fluid communication with the slot;

wherein the first pump assembly further comprises a swivel plate having a flange parallel to the end face of the first wobble plate and axially spaced from the end face of the first wobble plate;

wherein the piston extends axially through a bore in the flange;

wherein the swivel plate is adapted to pivot relative to housing as the first wobble plate is rotated;

wherein the swivel plate is biased axially towards the first wobble plate;

wherein the first pump assembly further comprises a guide member including a throughbore, wherein the piston slidingly engages the throughbore of the guide member;

wherein the guide member includes a recess extending axially from an end of the guide member;

wherein the first pump assembly further comprises a biasing sleeve slidingly received by the recess and a biasing member disposed in the recess and axially positioned between the biasing sleeve and the guide member;

wherein an end of the biasing sleeve includes an annular seat;

wherein the swivel plate includes an annular convex surface pivotally seated in the annular seat.

12. The pump of claim 11, wherein the throughbore of the piston is in fluid communication with a passage in the housing, and wherein a check valve allows one-way fluid flow from the throughbore of the piston into the passage.

13. The pump of claim 11, further comprising a fluid conduit extending axially through the hydraulic pump, wherein the fluid conduit is adapted to supply the fluid to the fluid end pump.

14. The pump of claim 11, wherein the first pump assembly includes:

a plurality of pistons, each piston adapted to reciprocate axially relative to the housing, wherein each piston has a first end, a second end opposite the first end, and a throughbore extending between the first end and the second end;

wherein the first wobble plate is adapted to rotate about the central axis relative to each piston and cyclically place the throughbore of each piston in fluid communication with the slot.

15. The pump of claim 14, wherein the flange of the swivel plate includes a plurality of circumferentially spaced bores, and wherein one piston extends axially through each bore in the flange.

16. The pump of claim 11, wherein the housing includes a second internal pump chamber axially spaced from the first internal pump chamber;

wherein a second pump assembly is disposed in the second internal pump chamber of the hydraulic pump;

wherein the second pump assembly includes:

a piston adapted to reciprocate axially relative to the housing, wherein the piston has a first end, a second end opposite the first end, and a throughbore extending between the first end and the second end;

a second wobble plate including a planar end face axially adjacent the second end of the piston of the second pump assembly and a slot extending axially through the second wobble plate, wherein the slot in the second wobble plate is disposed at a uniform radius from the central axis and the end face of the second wobble plate is oriented at an acute angle relative to the central axis;

wherein the second wobble plate is adapted to rotate about the central axis relative to the housing to axially reciprocate the piston of the second pump assembly and cyclically place the throughbore of the piston of the second pump assembly in fluid communication with the slot of the second wobble plate.

17. The pump of claim 16, wherein the first and second wobble plates are counter-opposed.

18. A method for deliquifying a well, comprising:

(a) positioning a deliquitication pump into a wellbore with a tubing string, the deliquification pump comprising;

a fluid end pump;

a hydraulic pump coupled to the fluid end pump;

an electric motor coupled to the hydraulic pump; and a separator coupled to the electric motor;

(b) powering the fluid end pump with the hydraulic pump;

(c) powering the hydraulic pump with the electric motor;

(d) sucking well fluids into the separator, wherein the well fluids include a liquid phase and a plurality of solid particles disposed in the liquid phase;

(e) separating at least a portion of the solid particles from the liquid phase to generate processed well fluids;

(f) flowing the processed well fluids to the fluid end pump, wherein the processed well fluids pass through a conduit that extends through the electric motor and the hydraulic pump; and (g) pumping the processed well fluids to the surface with the fluid end pump.

19. The method of claim 18, wherein (e) comprises cyclonically separating at least a portion of the solid particles from the liquid phase to generate the processed well fluids.

20. The method of claim 18, wherein (b) further comprises:

compressing a hydraulic fluid with the hydraulic pump; and communicating the compressed hydraulic fluid from the hydraulic pump to the fluid end pump.

21. The method of claim 18, wherein (a) comprises deploying the deliquification pump downhole with a mobile deployment vehicle.

22. The method of claim 21, wherein the tubing string is a spoolable tubing string deployed from the deployment vehicle.

23. The method of claim 18, further comprising powering the electric motor with electricity provided from the surface through one or more conductors in the spoolable tubing.

* * * * *